US010362885B2

(12) United States Patent
Walterspiel

(10) Patent No.: US 10,362,885 B2
(45) Date of Patent: Jul. 30, 2019

(54) DEVICES AND METHODS TO PROTECT NEONATES DURING BED-SHARING AND CO-SLEEPING

(71) Applicant: Juan Nepomuc Walterspiel, Menlo Park, CA (US)

(72) Inventor: Juan Nepomuc Walterspiel, Menlo Park, CA (US)

( * ) Notice: Subject to any disclaimer, the term of this patent is extended or adjusted under 35 U.S.C. 154(b) by 0 days.

(21) Appl. No.: 16/038,882

(22) Filed: Jul. 18, 2018

(65) Prior Publication Data

US 2019/0029441 A1 Jan. 31, 2019

Related U.S. Application Data

(60) Provisional application No. 62/538,099, filed on Jul. 28, 2017, provisional application No. 62/592,040, filed on Nov. 29, 2017.

(51) Int. Cl.
*A47D 15/00* (2006.01)

(52) U.S. Cl.
CPC ..... *A47D 15/008* (2013.01)

(58) Field of Classification Search
CPC . A47D 9/00; A47D 7/04; A61G 11/00; A61G 2200/14
See application file for complete search history.

(56) References Cited

U.S. PATENT DOCUMENTS 183,357 A * 10/1876 Woodward ..... A47D 9/02 5/101
209,623 A * 11/1878 Noble ..... A47D 9/02 5/101
454,191 A * 6/1891 Weber ..... A47D 9/02 5/104
1,453,942 A * 5/1923 Mills ..... A47D 13/02 220/491
2,234,515 A * 3/1941 Auguste ..... A47D 9/00 126/204
3,898,427 A * 8/1975 Levin ..... A61F 7/00 128/205.26
5,233,710 A 8/1993 Bernard
(Continued)

*Primary Examiner* — Eric J Kurilla
(74) *Attorney, Agent, or Firm* — D. Benjamin Borson; Borson Law Group PC

(57) ABSTRACT

This disclosure provides designs for inexpensive devices that can be sturdy, pleasing to the eye, light in weight, and attractively padded, to form an enclosure around an infant or neonate that is open at its bottom. These devices protect neonates from injury during bed-sharing or co-sleeping with other individuals. These enclosures can include single or multiple roll-over bars to protect infants and neonates from being injured or asphyxiated by weight of a co-sleeper inadvertently moving on top of a roll-over bar. Devices can be shaped to allow for easy placement and removal of the infant, or to place the enclosure with the respective roll-over bar(s) over an infant. Roll-over bar(s) can be/hinged or intercalated with pivots to deflect frame base portions when an infant body part finds itself accidentally caught under them. The rotation can be limited to an angle that still allows for the roll-over bar to be above an infant's body when frame base portion(s) are raised above the sleeping surface by the pressure and forces exerted on a roll-over bar when a co-sleeper inadvertently moves over a roll-over bar.

11 Claims, 24 Drawing Sheets

300

(56) References Cited

U.S. PATENT DOCUMENTS

| | | | | | |
|---|---|---|---|---|---|
| 5,341,530 | A * | 8/1994 | Ward | A47D 9/005 | 383/18 |
| 5,464,381 | A * | 11/1995 | Wilson | A47D 9/02 | 297/184.13 |
| 5,511,572 | A * | 4/1996 | Carter | E04H 15/50 | 135/127 |
| 5,528,785 | A | 6/1996 | Petrus | | |
| 5,685,076 | A * | 11/1997 | Curley | E04H 15/40 | 135/95 |
| 5,713,090 | A | 2/1998 | Rodgers | | |
| 5,806,924 | A * | 9/1998 | Gonas | B60N 2/2821 | 297/216.11 |
| 5,930,854 | A * | 8/1999 | O'Neill | A47D 13/063 | 135/135 |
| 6,549,140 | B1 | 4/2003 | Koessler | | |
| 6,550,083 | B1 * | 4/2003 | LaMantia | A47C 29/003 | 135/96 |
| 8,893,327 | B1 * | 11/2014 | Muhammad | A47D 9/00 | 5/101 |
| 2005/0172411 | A1 * | 8/2005 | Snedeker | A47D 13/02 | 5/655 |
| 2011/0191956 | A1 | 8/2011 | Rabess | | |
| 2012/0246824 | A1 * | 10/2012 | Friedman | A47D 7/04 | 5/95 |
| 2014/0137324 | A1 * | 5/2014 | Doering | A47D 9/00 | 5/93.1 |
| 2016/0135608 | A1 | 5/2016 | Hashiba | | |

* cited by examiner

300

300

400

400

400

500

700

1200

1201

DEVICES AND METHODS TO PROTECT NEONATES DURING BED-SHARING AND CO-SLEEPING

PRIORITY CLAIM

This United States non-provisional application is filed under 35 U.S.C. 111a, and claims priority to U.S. Provisional Patent Application No. 62/592,040 filed 2017 Nov. 29 entitled "Devices and Methods to Protect Neonates During Bed-Sharing and Co-Sleeping, Juan Nepomuc Walterspiel, inventor, and to U.S. Provisional Patent Application No. 62/538,099 filed 2017 Jul. 28 entitled "Devices and Methods to Protect Neonates During Bed-Sharing and Co-Sleeping, Juan Nepomuc Walterspiel, inventor. Both of these Provisional Applications are herein incorporated fully by reference.

TECHNICAL FIELD

This disclosure relates to passive devices and methods to protect an infant during co-sleeping and bed-sharing.

BACKGROUND

The American Academy of Pediatrics (AAP) issued recommendations to reduce sleep-related infant death, which advise against all bed-sharing for sleep, because infants or neonates can inadvertently be rolled-over, squished, pressed into a mattress, covered by blankets, pillows, bedcovers, toys, or other movable objects and become asphyxiated.

SUMMARY

Protective enclosures having roll-over bars, frames, covers, and dome-like structures and combinations thereof are disclosed that can be situated around and above a supine infant or neonate while another person ("co-sleeper") shares a sleeping surface with the infant.

This disclosure offers a safe, inexpensive, infant or neonate age limited (up to 3-4 months of age) alternatives or additions to bedside cribs, bassinettes, baby beds, corals, pens, attachments and other infant bedding provisions.

The disclosure addresses a common problem, namely allowing for safe bed-sharing and co-sleeping with an infant or neonate.

This disclosure relates to devices and methods to keep an infant or neonate enclosed on a bed or other sleeping surface, and to protect the infant from being injured and/or asphyxiated by a caretaker. Protective roll-over bar(s) arise from frame base elements of the enclosure and arch over the infant or neonate. The roll over-bar(s) and/or frame base elements is/are hinged, so that either end of the frame base can move up or rotate should an infant or neonate or one of his body parts finds itself accidentally caught under the enclosure. The angle of this passive rotational safety movement is limited so that the roll-over bar cannot press on the infant or neonate. Devices of this disclosure operate automatically when a co-sleeper moves on top of a roll-over bar. Pressure in the roll-over bar is transmitted through hinges, pivots, or rotational elements to the frame base portions, thereby elevating at least one frame base portion, so an infant or neonate's extremity, head, or torso is not subjected to the weight of the co-sleeper.

The disclosed devices encourage the recommended supine (nose up) sleeping position and make it less likely for potentially smothering or breath trapping objects to be placed in proximity to an infant or neonate.

BRIEF DESCRIPTION OF THE DRAWINGS

This invention is described with reference to specific embodiments thereof. Other features of the embodiments can be understood with respect to the drawings, in which:

FIG. 1*a* shows a top view of an embodiment. FIG. 1*b* shows an oblique side view of this embodiment. FIG. 1*c* depicts an oblique side view of an embodiment in which a hinge is rotated.

FIG. 2*a* is a top view of this embodiment. FIG. 2*b* shows an oblique side view of this embodiment. FIG. 2*c* is another oblique view of this embodiment.

FIG. 3*a* is a top view of this embodiment. FIG. 3*b* is an oblique side view of this embodiment. FIG. 3*c* is an oblique view of this embodiment, wherein the base of the embodiment has a hinge attaching it to the roll-over bar.

FIG. 4*a* is a top view, FIG. 4*b* is an oblique side view, and FIG. 4*c* is another oblique side view of this embodiment.

FIG. 5*a* is a top view, FIG. 5*b* is an oblique side view, and FIG. 5*c* is another oblique side view.

FIG. 6*a* is a top view, FIG. 6*b* is an oblique side view, and FIG. 6*c* is a drawing where the base frame has been bent.

FIG. 8*a* depicts embodiment 800 shown in closed configuration and FIG. 8*b* depicts embodiment 801 is shown in open configuration.

FIG. 9*a* depicts embodiment 900 shown in closed configuration and FIG. 9*b* depicts embodiment 901 shown in open configuration.

FIG. 10*a* depicts embodiment 1000 shown in closed configuration and FIG. 10*b* depicts embodiment 1001 shown in open configuration.

DETAILED DESCRIPTION

Figure 1A:
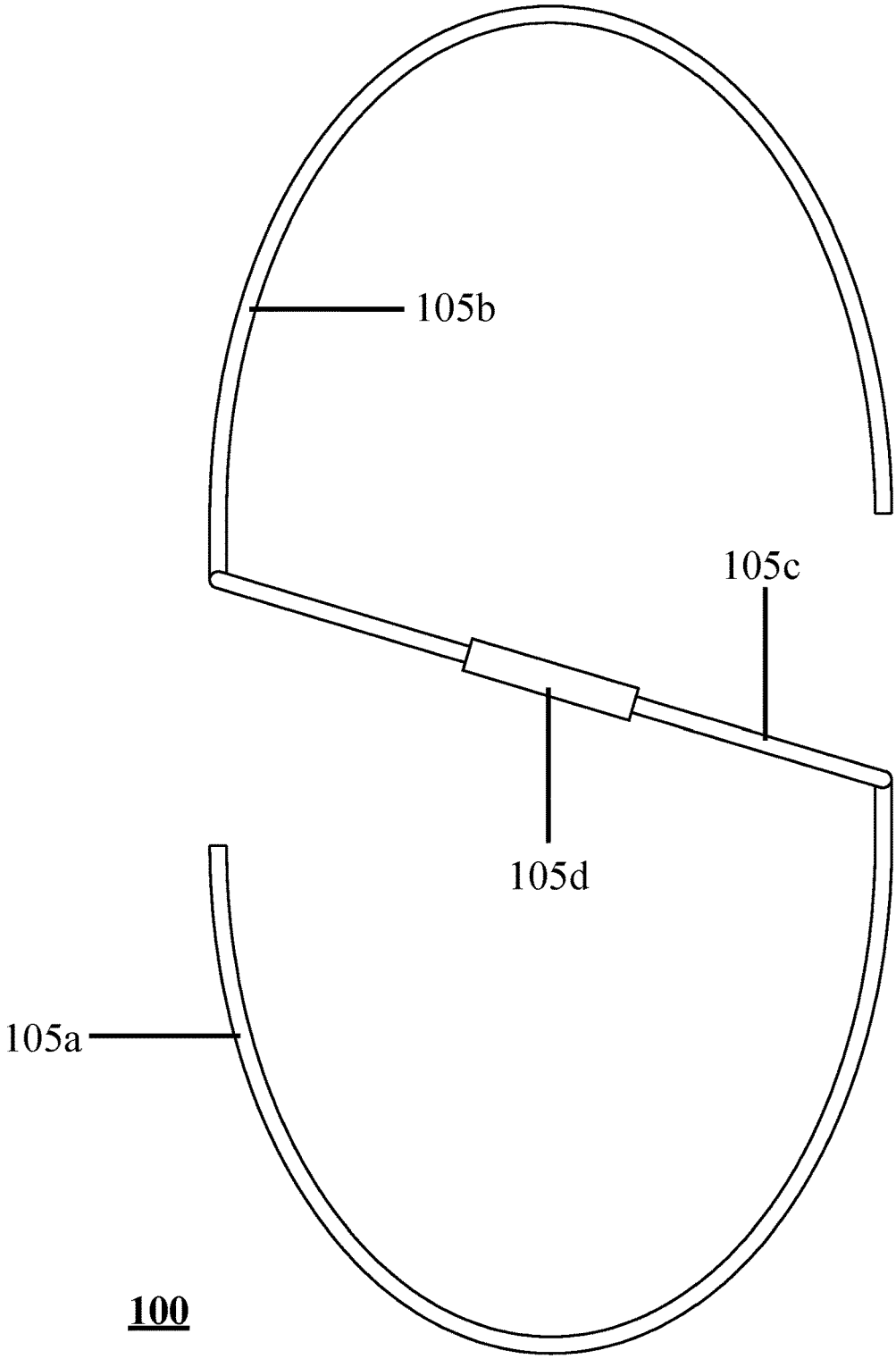
FIGS. 1*a*, 1*b*, and 1*c* depict drawings of an embodiment of a portable protective frame for an infant or neonate.

Bed-sharing and co-sleeping follows a healthy maternal or paternal instinct. The proximity to a neonate facilitates bonding and increases the comfort and duration of breast-feeding with its salutary effects for the mother and her infant.

The disclosures allow for mothers, fathers, partners, and other infant caretakers to share a bed with them without fears for the infant's safety.

ASPECTS OF THE DISCLOSURE

The following aspects of the disclosure are presented for illustration only, and are not intended to limit the scope of the disclosure. The following aspects can be used in conjunction with other aspects.

One aspect is an open protective infant device with an enclosure having a frame base that is contiguously or non-contiguously attached to one or more a roll-over bars arching over an infant to protect an infant during bed-sharing or co-sleeping and also other living or non living objects from mechanical intrusions. In situations where a co-sleeper moves on top of a device, the force or pressure of the co-sleeper pressed down on the roll-over bar, which transmits the force, through hinges, pivots, or rotational elements to the frame base portions, thereby elevating at least one frame base portion, so an infant or neonate's extremity, head, or torso is not subjected to the weight of the co-sleeper. The devices of this disclosure thereby protects the infant or neonate from being injured, and reduces the chance of suffication.

Aspects of this disclosure includes one or more base portions, that are able to be moved relative to each other, to allow for the based to be moved away from an infant or an infant's body parts.

Another aspect has at least one roll-over bar incorporating at least one motion limited hinge, pivot or rotational element and the enclosure to be interrupted at least at two locations to allow for the enclosure to lift in order to diminish pressure and avoid injury to an infant or body parts that may accidentally find themselves caught under it.

A further aspect includes two longitudinal roll-over bars that are far enough apart from each other at their apex for an infant's neck or head to not get caught in between.

Another aspect includes horizontal roll-over bars at both ends of the device and hinges in the middle of the lateral enclosures.

A still further aspect includes a single longitudinal, undulated roll-over bar that covers more space on both sides.

An additional aspect parts of the enclosure(s) having a spiral and/or undulated form.

Additional aspects include a frame base being covered in full or in part with exchangeable, washable, water repellent, or other material characteristics, padding of any circular or edged or combined vertical cut form, reaching up to 10 cm or 4 inches from the center of the frame base.

Further aspects include embodiments in which all potentially body part catching angles or recessions are closed off.

Additional aspects include embodiments which can be firmly affixed and removed to a bed's siding, a bed's head, a bed's frame, a bed sheet or on or into a mattress. Other embodiments include embodiments that can be disassembled and reassembled at least one location of the enclosure or roll-over bar to facilitate shipping.

Further aspects include embodiments that can be elongated or shorted at least one location of the enclosure or roll-over bar to adapt to the size of a given and growing infant.

Additional aspects include embodiments equipped with one or more pressure and/or movement sensors that communicate with their respective alarm and recording devices to warn a caretaker or co-sleeper of a problem.

Further aspects include frame bases without pliable covering.

PRIOR ART

The following publications are described to provide some information on the state of the art. Applicant makes no representation that any of the publications are material to patentability of the claims.

U.S. Pat. No. 9,554,659 discloses an infant sleep providing passive and/or active safety features. The infant sleep pod provides a safe sleeping environment for infants sharing sleep areas with adults. The infant sleep pod provides a firm, flat, separate, portable, and dedicated sleep space for an infant. The infant sleep pod includes a base with a bed and sidewall, and a bridge extending across the bed. The bridge covers a head portion of the bed, while a foot portion of the bed is left open for inserting and removing the infant. The bridge prevents pillows and blankets from covering the bed and infant. The infant sleep pod also includes electronics for monitoring the sleep pod. The electronics include a sensor unit in the bridge and a control unit in communication with the sensor unit. The control unit and sensor unit are operable to detect unsafe conditions and, in response, generate alerts.

This patent does not disclose any frame members or roll-over bars having hinges, pivots, or rotatable elements that can raise a frame base element in response to pressure or force applied to a roll-over bar.

U.S. Pat. No. 9,549,619 discloses cushions for co-sleeping, including structures configured to secure to a mattress or other sleeping surface, permitting cushion re-shaping to divide or otherwise configure a sleeping space. Cushions join to the mattress via an L-shaped plate that seats against a side and under a bottom of the mattress. The cushion is supported by the L-shaped plate, which may extend inside the cushion or otherwise mate with a flexibile shaping pipe in the cushion. The flexible pipe in the cushion allows the cushion to be shaped in any fashion with sufficient human force while retaining its shape when slept on. The L-shaped plate is joined to an opposite latch plate that secures to an opposite side of the mattress by an adjustable belt that runs between the L-shaped plate and latch plate. The belt may run under the mattress and join to any number of structures.

This patent does not disclose any frame members or roll-over bars having hinges, pivots, or rotatable elements that can raise a frame base element in response to pressure or force applied to a roll-over bar.

U.S. Pat. No. 5,713,090 discloses a bed enclosure having a dome-shaped frame to protect a baby from being injured by a co-sleeper rolling onto the dome-shaped frame.

This patent does not disclose any frame members or roll-over bars having hinges, pivots, or rotatable elements that can raise a frame base element in response to pressure or force applied to a roll-over bar.

U.S. Pat. No. 6,549,140 discloses an infant protective bed having a resilient bumper around the perimeter of the bed. The resilient bumper is provided with spring-loaded switch activation members as part of an alarm assembly that is so configured to sense if an adult rolls on to the bumper member, the arm either sounds a loud alarm or vigorously vibrates the bumper member, or both, if desired.

This patent does not disclose any frame members or roll-over bars having hinges, pivots, or rotatable elements that can raise a frame base element in response to pressure or force applied to a roll-over bar.

U.S. Pat. No. 5,233,710 discloses a collapsible child restrainer having a triangular tube with a right angle between a base panel for resting on a surface and a vertical panel. The vertical panel provides a child restraining wall, and the restrainer is connected to other similar restrainers at an angle of 90 degrees to form a rectangular crib area for infants. The vertical panel is collapsible to be flat on the resting surface, and restrainer can be put in line with another restrainer to form a longer restrainer wall for children of 18 months to 2 years.

This patent does not disclose any frame members or roll-over bars having hinges, pivots, or rotatable elements that can raise a frame base element in response to pressure or force applied to a roll-over bar.

U.S. Pat. No. 5,528,785 discloses an attachable couch-cushion confining device for infants. A confining device couch converter which converts a seat cushion of a couch into a confining device for resting baby. The confining device includes a sheet portion, which is flat, for covering a portion of the seat cushion where the baby rests. A wedge positioned along a perimeter of the sheet portion provides a barrier so that the baby does not fall onto the floor. An attaching portion connects the sheet portion to the seat cushion so that the confining device is secured to the seat cushion.

This patent does not disclose any frame members or roll-over bars having hinges, pivots, or rotatable elements that can raise a frame base element in response to pressure or force applied to a roll-over bar.

U.S. Pat. No. 8,245,337 discloses a baby portable bed and secure device for keeping baby in position while asleep or laying. This device foam tubing inserts covered by fabric that form bumpers and kept rigid in place by stitching on the fabric.

This patent does not disclose any frame members or roll-over bars having hinges, pivots, or rotatable elements that can raise a frame base element in response to pressure or force applied to a roll-over bar.

EXAMPLES

The following examples are intended to illustrate specific embodiments of this invention. However, it is recognized that persons of skill in the art can use the teachings of this disclosure to produce other embodiments to serve similar purposes to those disclosed herein. All such embodiments are considered part of this disclosure.

Example 1

Figure 1B:
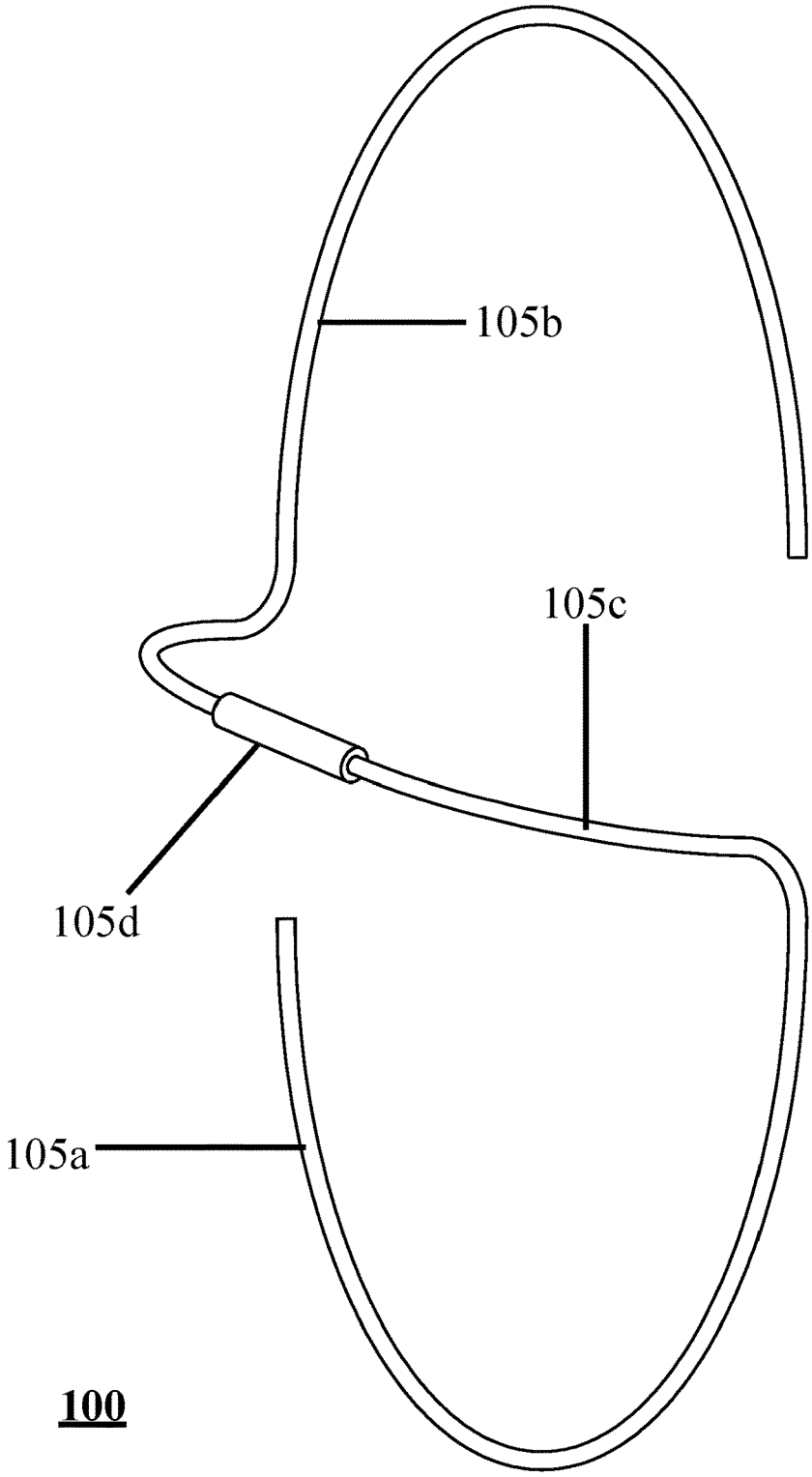
Figure 1C:
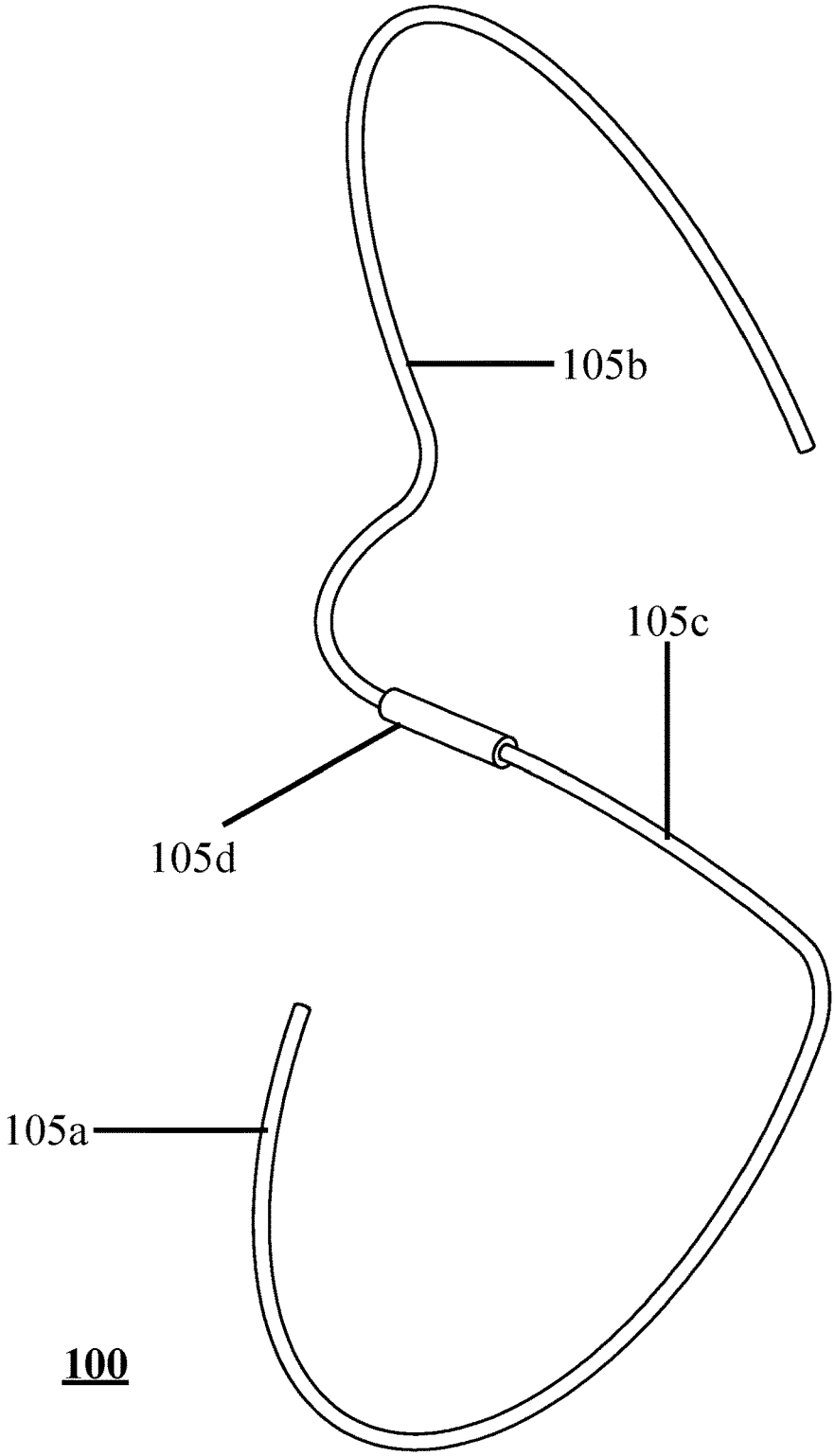

FIGS. 1*a*, 1*b*, and 1*c* depict drawings of an embodiment 100 of a portable protective frame for an infant. FIG. 1*a* shows a top view of an embodiment 100. This embodiment has a two-piece frame base (105*a* and 105*b*) and a two-piece roll-over bar 105*c* with one end of each of the pieces of the roll-over bar 105*c* being attached to the base frame, and having pivot 105*d* connecting the two pieces of the roll-over bar 105*c*.

FIG. 1*b* shows an oblique, side view of embodiment 100 where pivot 105*d* is shown at the apex, where the two pieces of roll-over bar 105*c* are connected. FIG. 1*c* depicts an oblique side view of an embodiment 100 in which pivot 105*d* has been rotated, thereby opening the base frame elements 105*a* and 105*b* from each other. In this drawing, pivot 105*d* has reached its maximal extension upon a lateral rollover, and any further movement of the infant is arrested with the rollover bar still high enough over the infant's body to protect the infant or neonate.

This embodiment 100 comprises a sturdy, non-extremity catching, infant enclosure, which can be covered by a soft, washable, and exchangeable padding, An S-shaped roll-over bar rises from its sides and arches over the infant. The S-shape allows for an easy placing and removal of the infant or placing it over an infant, regardless of the longitudinal orientation of the infant or device.

If a portion of the infant's body (e.g., legs, torso, arms, or head) becomes trapped under base frame 105*a* or 105*b*, pivot 105*d* can rotate to permit that portion of base frame 105*a* or 105*b* to become elevated, thereby avoiding harmful pressure being exerted on the infant.

Example 2

Figure 2A:
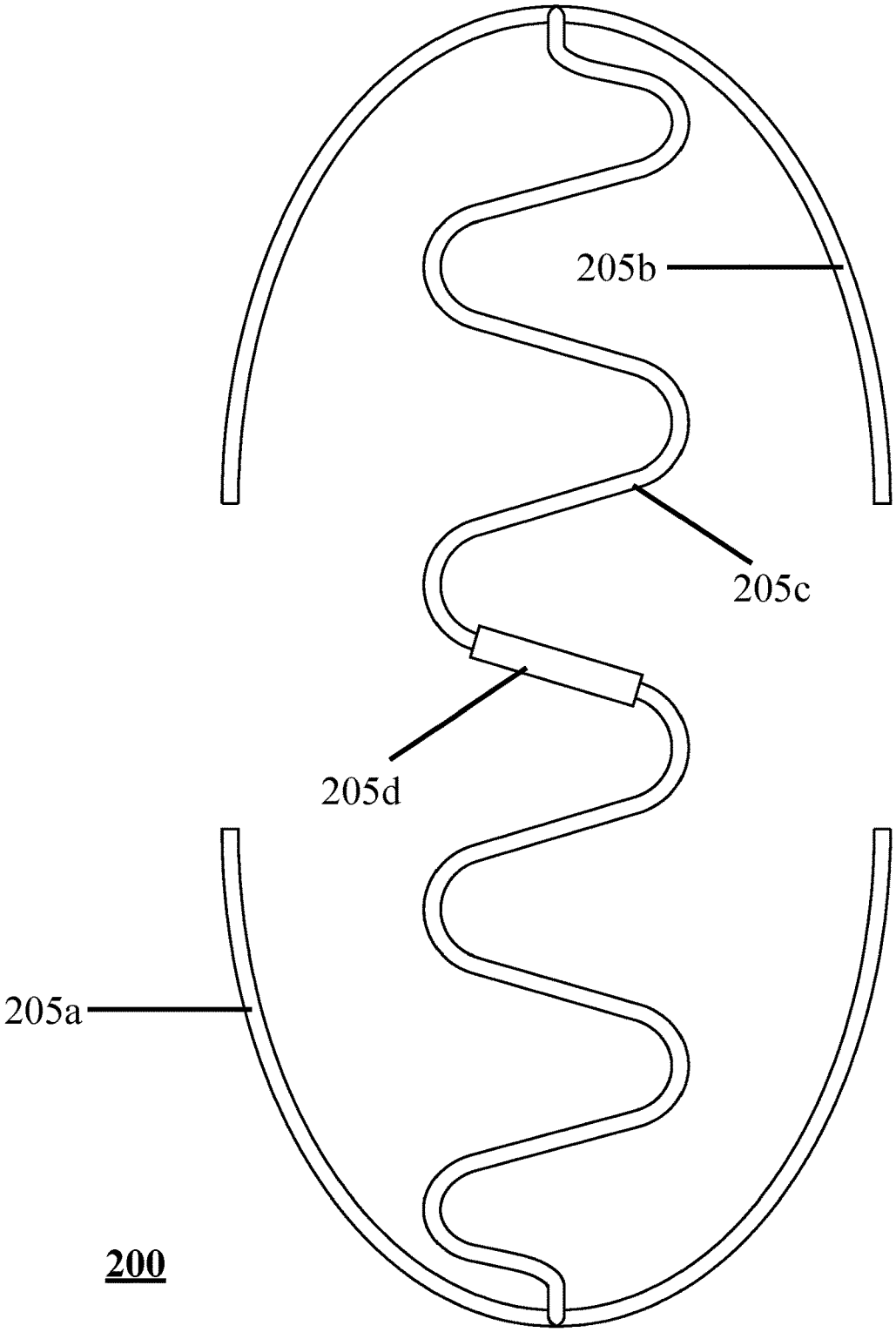
FIGS. 2*a*, 2*b*, and 2*c* show drawings of an embodiment having a alternate roll-over bar.
Figure 2B:
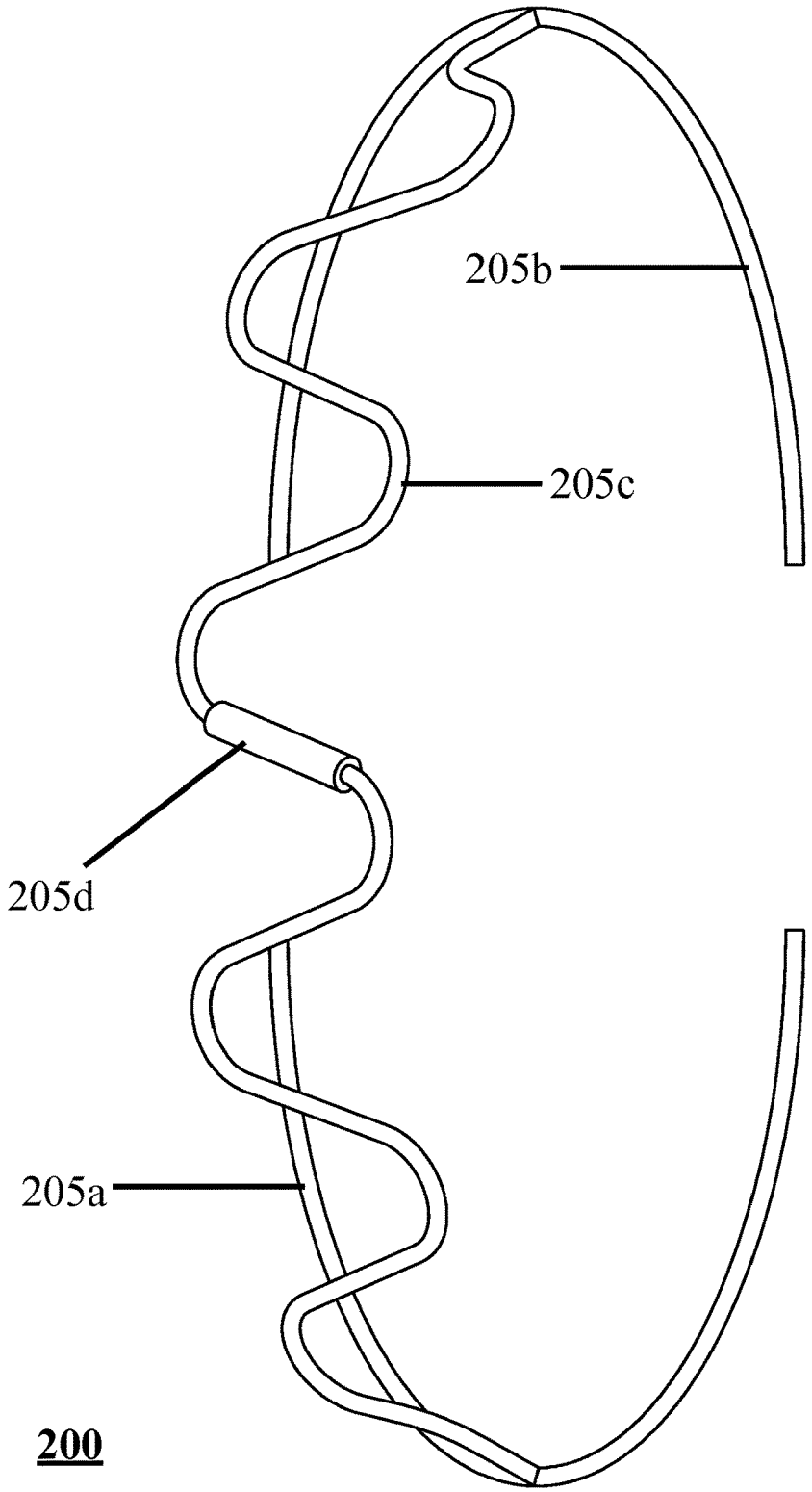
Figure 2C:
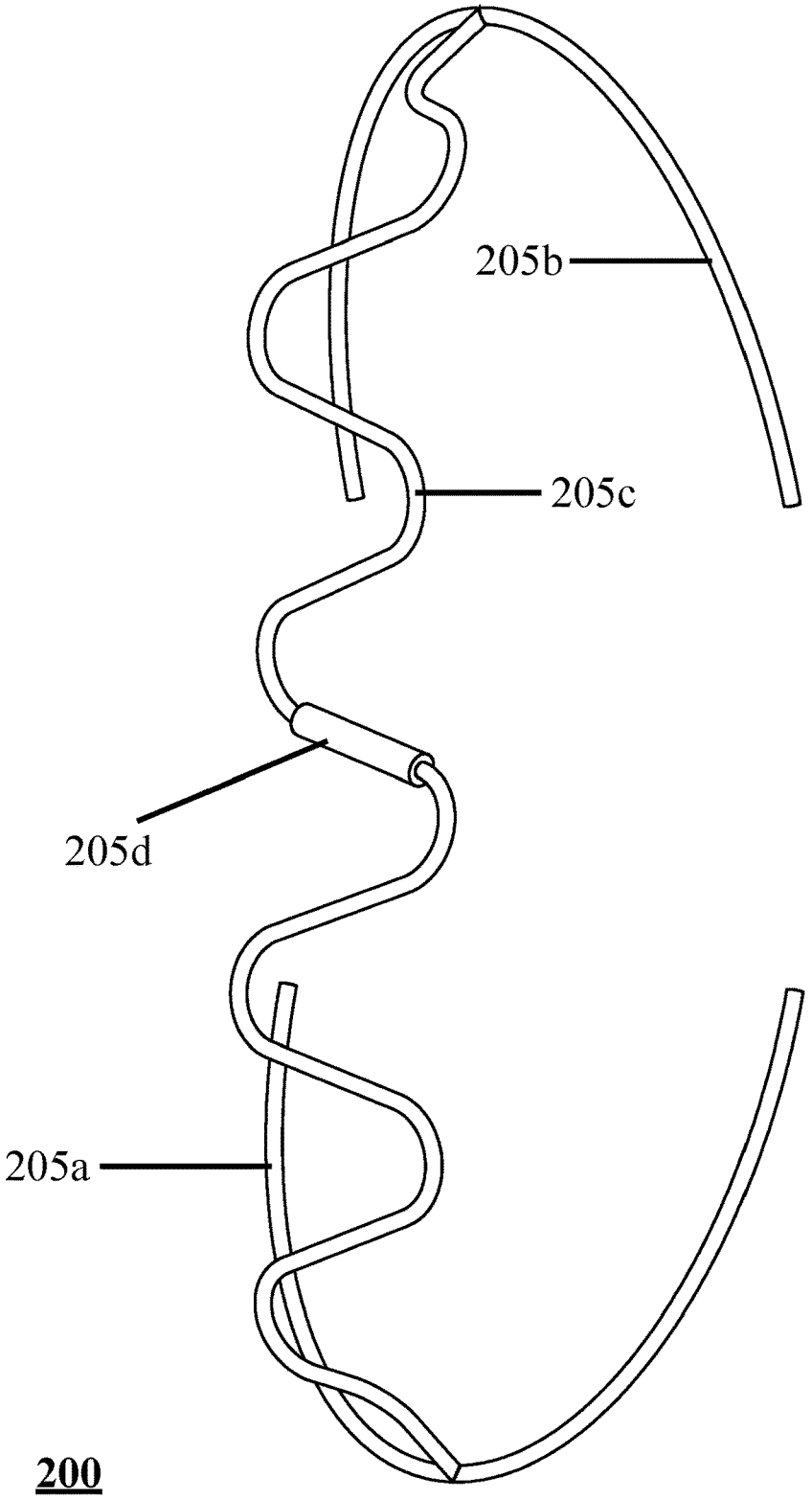

FIGS. 2*a*, 2*b*, and 2*c* show drawings of an embodiment 200 having an alternate roll-over bar. FIG. 2*a* is a top view of this embodiment. FIG. 2*b* shows an oblique side view of this embodiment. FIG. 2*c* is another oblique view of this embodiment.

The base frame of embodiment 200 has two curved pieces of a base frame 205*a* and 205*b*. The ends of the curved pieces of the base frame 205*a* and 205*b* are shown proximate to each other, defining a gap therebetween. Roll-over bar 205*c* comprises two pieces, with one end of each piece connected to one of the base frame 205*a* and 205*b*, and having pivot 205*d* shown connecting together the other ends of the two pieces of roll-over bar 205*c*.

Example 3

Figure 3A:
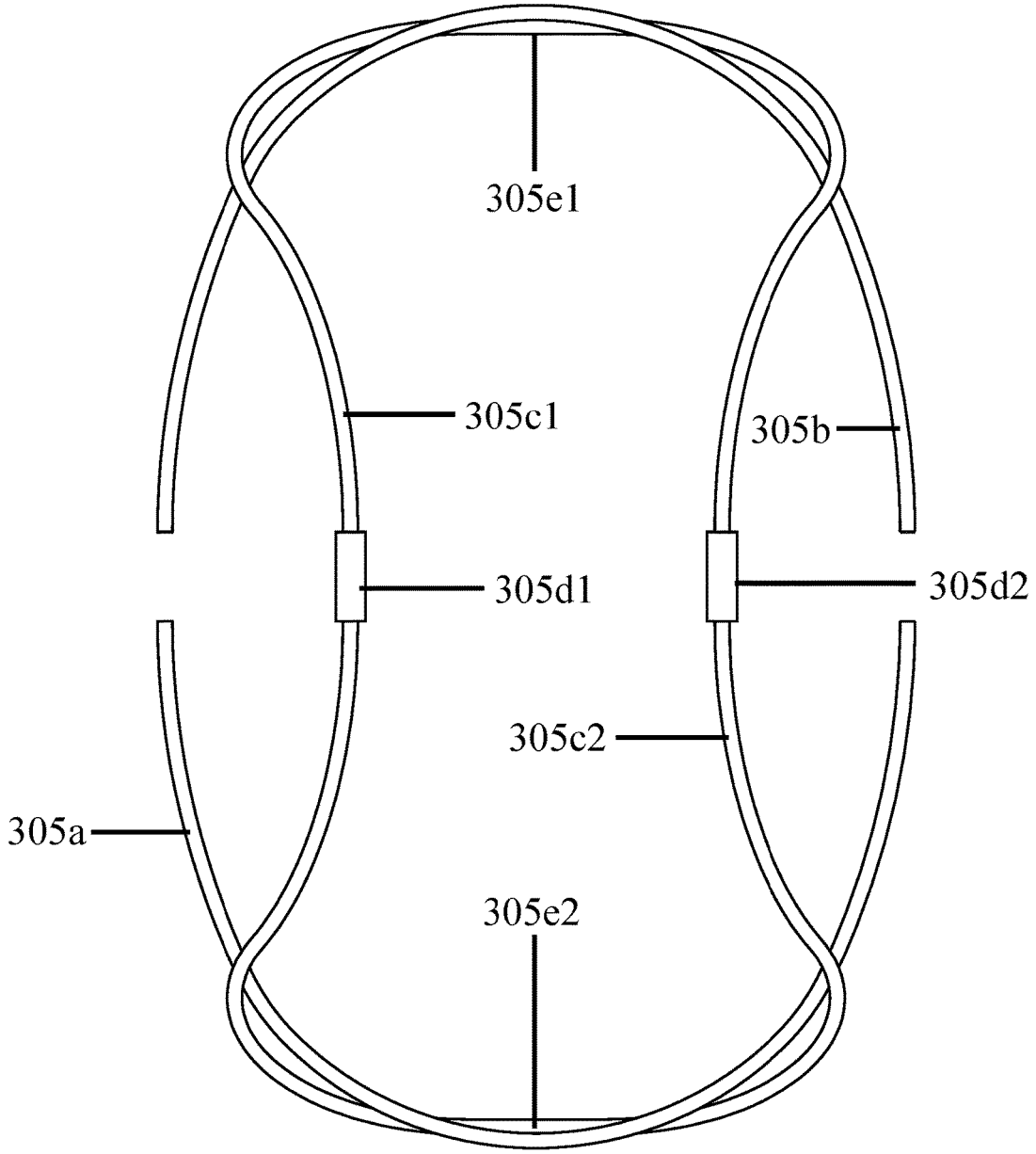
FIGS. 3*a*, 3*b*, and 3*c* show drawings of an embodiment having a different configuration of a roll-over bar.
Figure 3B:
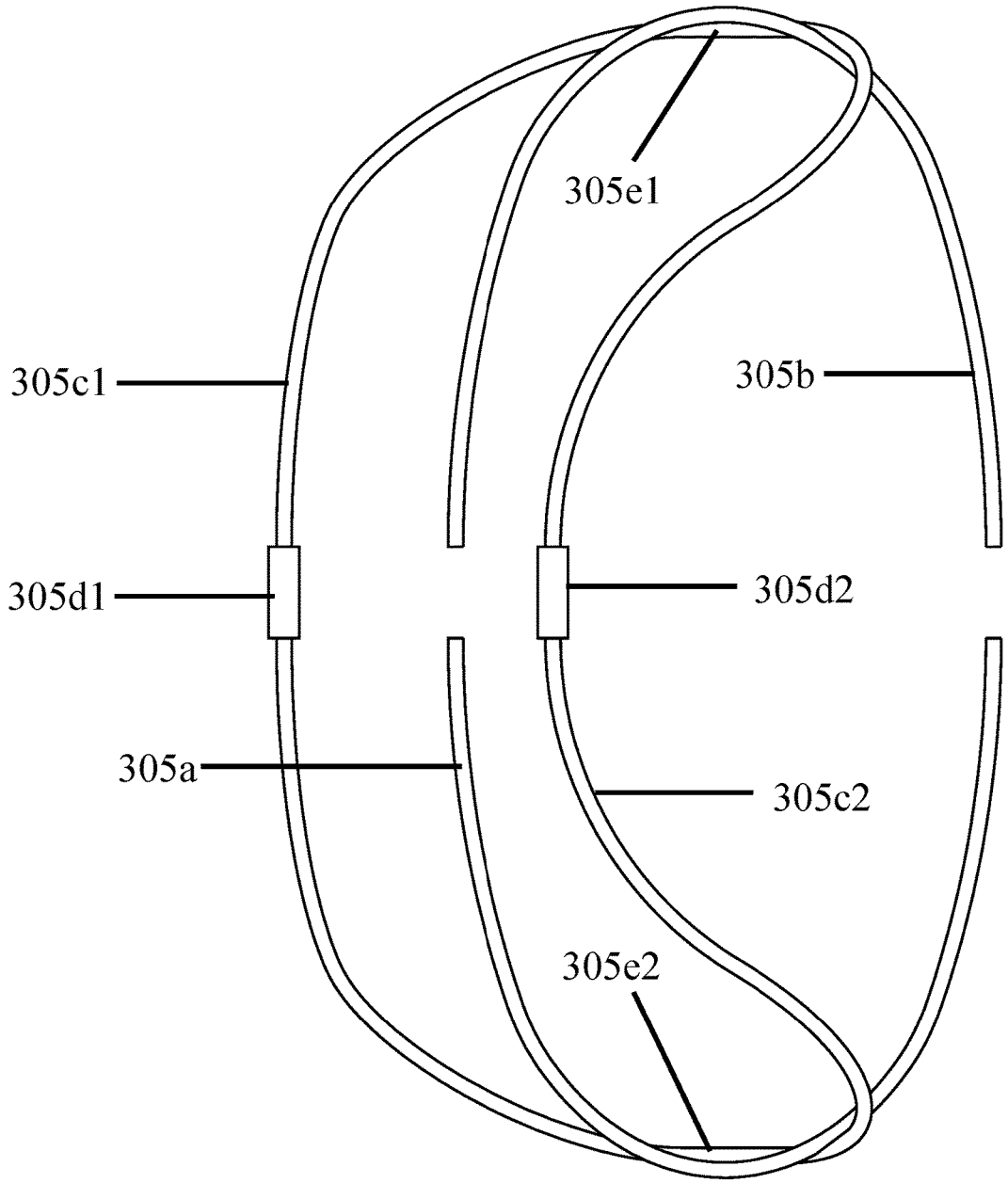
Figure 3C:
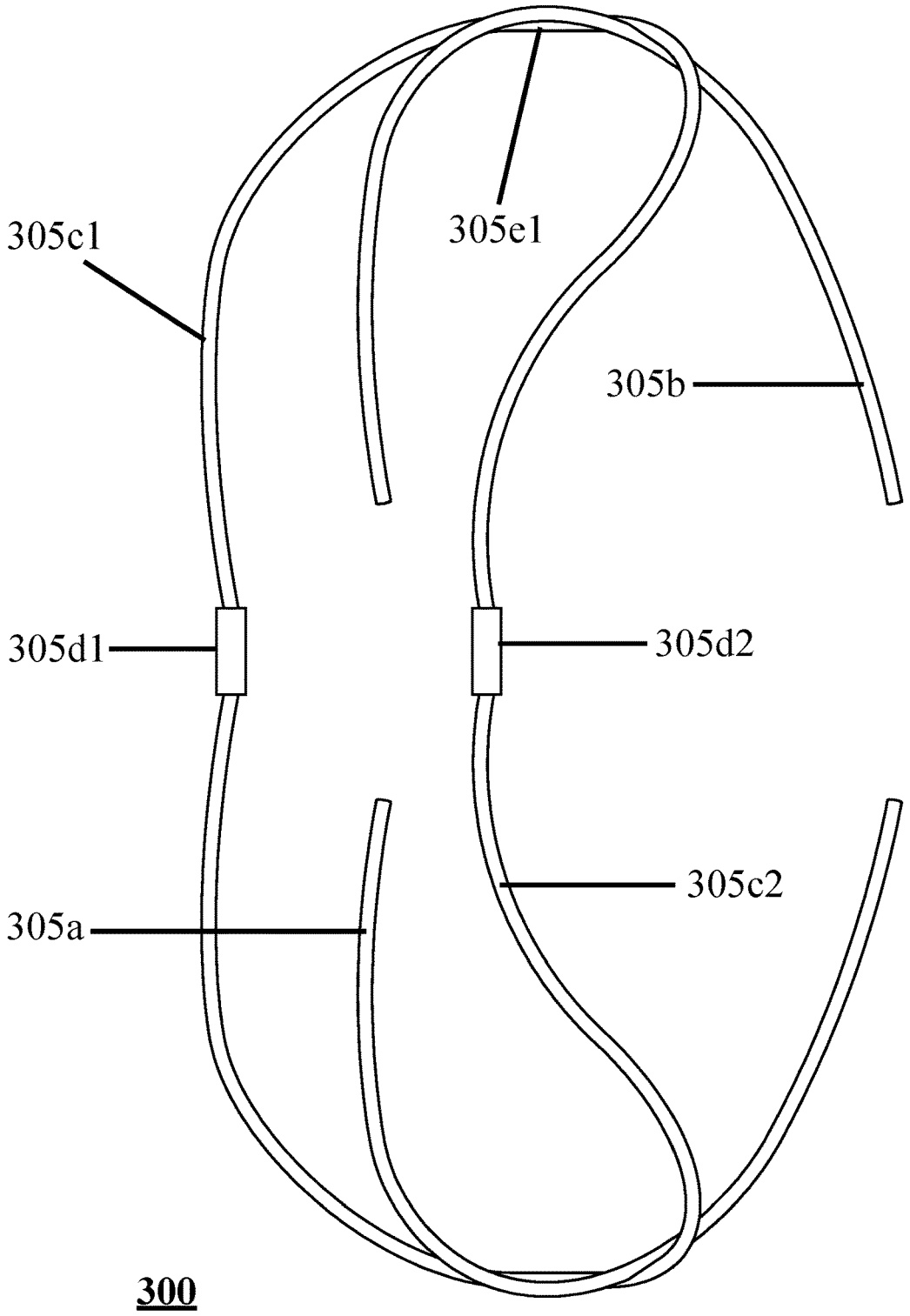

FIGS. 3*a*, 3*b*, and 3*c* show drawings of an embodiment 300, having two curved base pieces 305*a* and 305*b* arranged to have the ends of piece 305*a* proximate to the ends of piece 305*b* defining a gap therebetween. FIG. 3*a* is a top view of this embodiment. FIG. 3*b* is an oblique side view of this embodiment.

The roll-over bar comprises two curved pieces, 305*c*1 and 305*c*2 with the bottom ends of these pieces attached to base frame elements 305*a* and 305*b* using hinges 305*e*1 and 305*e*2, thereby permitting base frame elements 305*a* and/or 305*b* to be deflected relative to the roll-over bar. The ends of roll-over bar pieces 305*c*1 and 305*c*2 are connected together by pivots 305*d*1 and 305*d*2.

FIG. 3*c* is an oblique view of this embodiment, wherein the base piece 305*b* is shown rotated about hinge 305*e*1 thereby permitting base element 305*b* to be deflected downwards toward a surface upon which the device rests.

Example 4

Figure 4A:
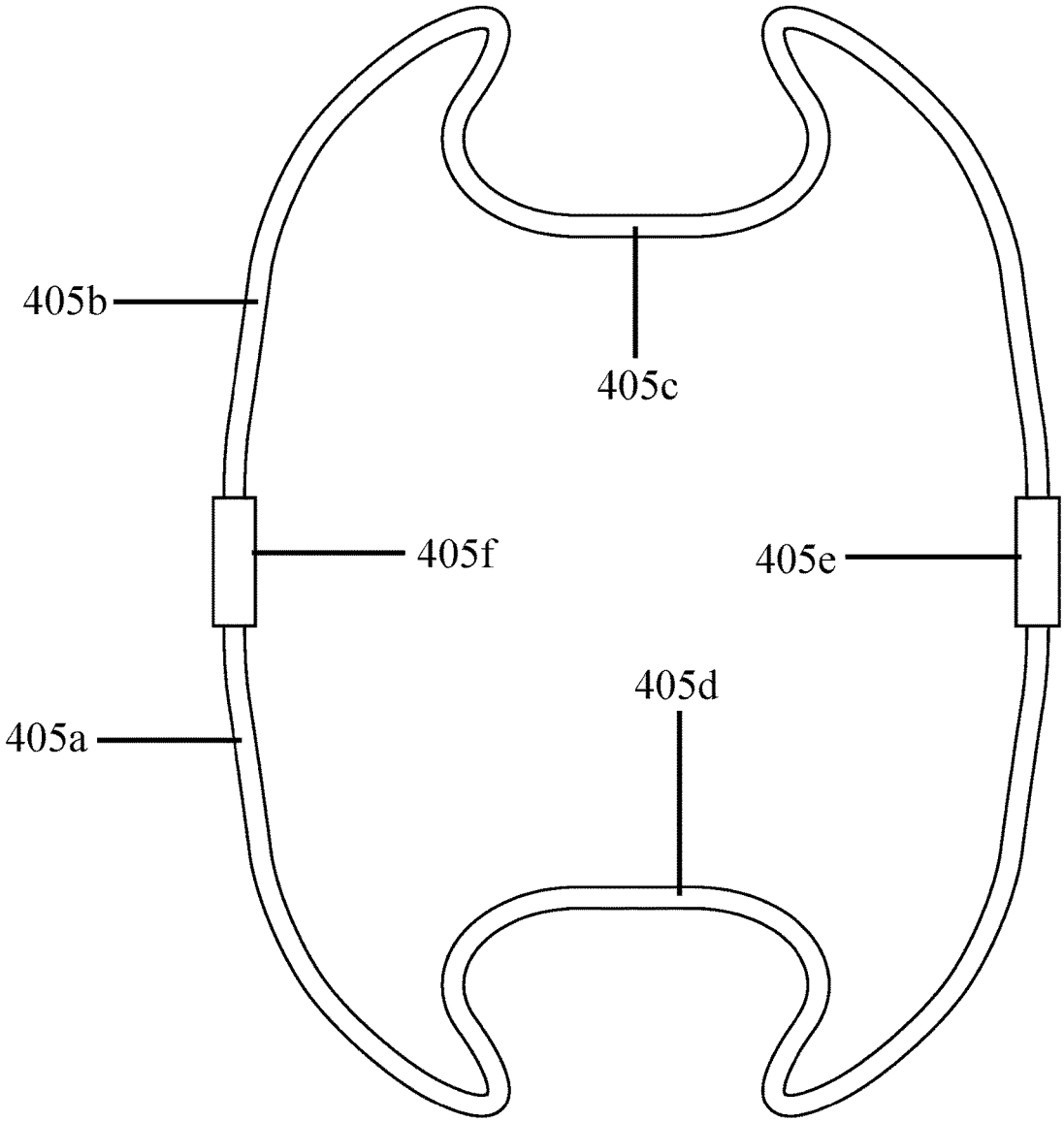
FIGS. 4*a*, 4*b*, and 4*c* show drawings of an alternate protective device, where the device is characterized by an interrupted enclosure and two roll-over bars.
Figure 4B:
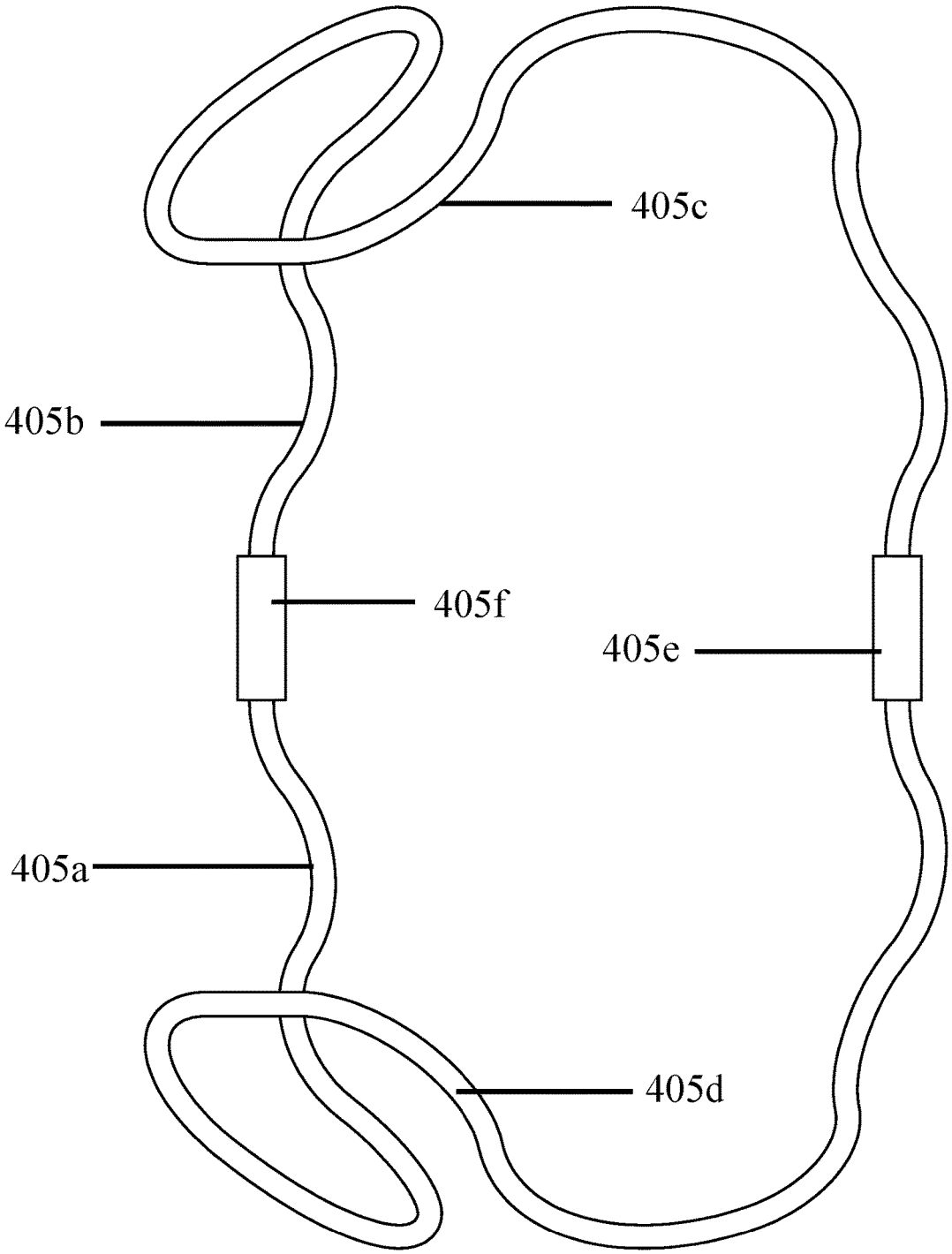
Figure 4C:
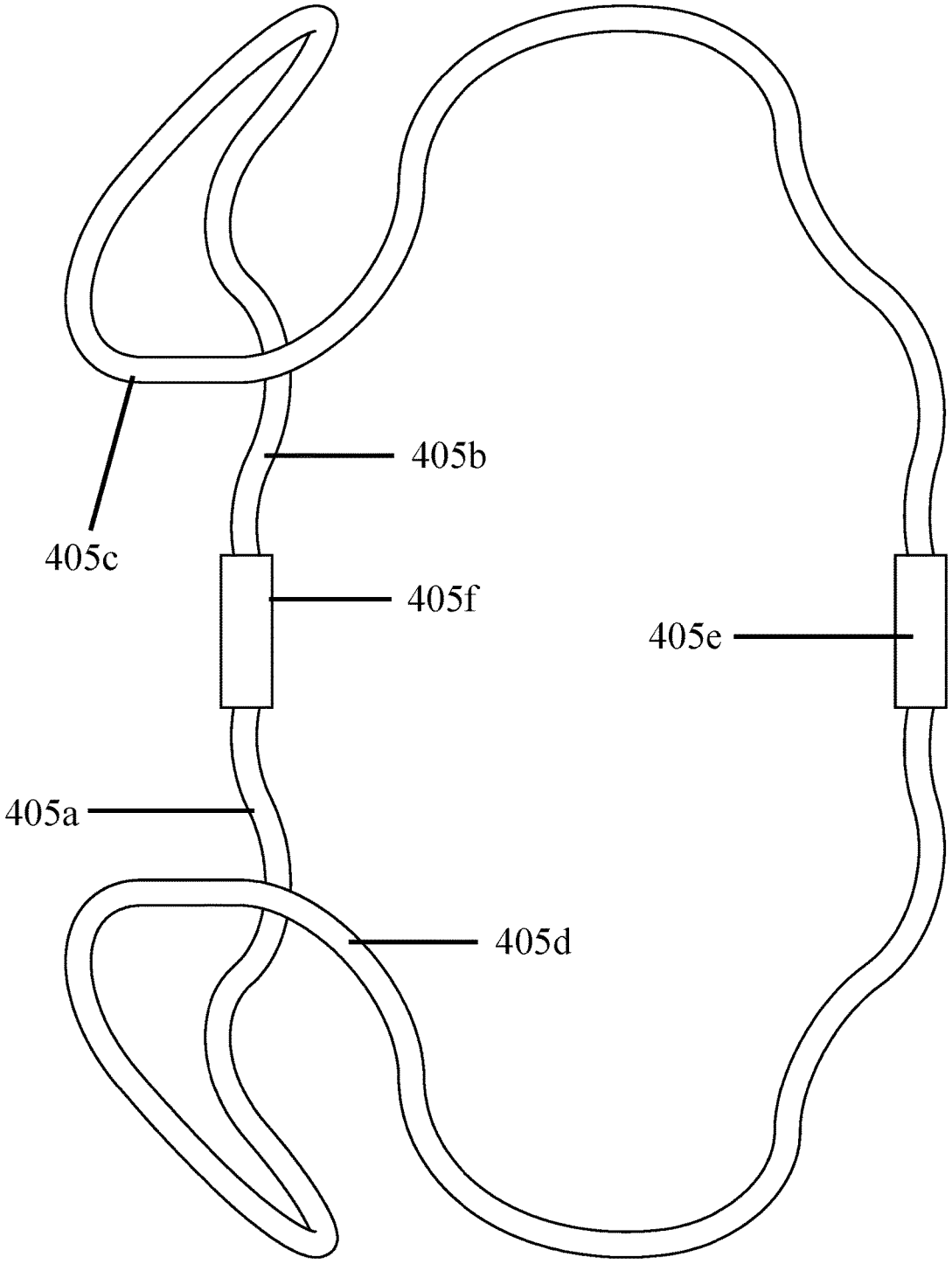

FIGS. 4*a*, 4*b*, and 4*c* show drawings of an alternate embodiment 400 of a protective device, where the device comprises an interrupted enclosure made having two frame base pieces 405*a* and 405*b*, with the ends of the two pieces 405*a* and 405*b* being connected together using flexible hinges 405*e* and 405*f*.

The roll-over bar comprises two pieces 405*c* and 405*d*, each being connected to frame base elements 405*a* and 405*b* by pieces and 405*e* and 405*f* of flexible tubing. FIG. 4*a* is a top view, FIG. 4*b* is an oblique side view, and FIG. 4*c* is another oblique side view of this embodiment.

This design allows for the pieces of roll-over bar 405*c* and 405*d* to be flexed away from each other, permitting an infant to be placed and removed from either side or even through the space between roll-over bar elements 405*c* and 405*d*. The roll-over-bars approach each other at their apex, but remain separated by enough of a distance that will prevent for an infant's neck or head to get caught underneath.

Example 5

Figure 5A:
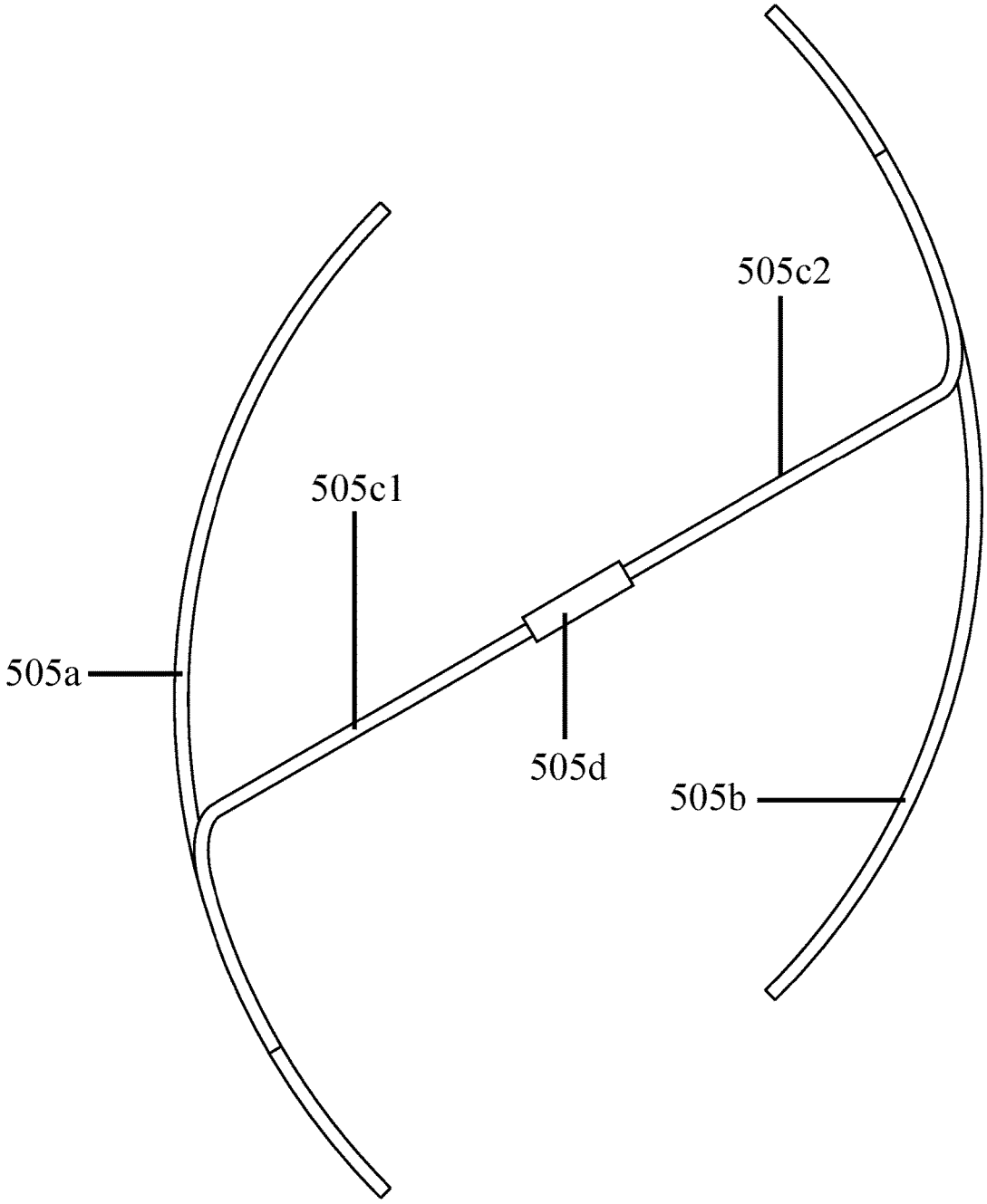
FIGS. 5*a*, 5*b*, and 5*c* show drawings of another alternate embodiment.
Figure 5B:
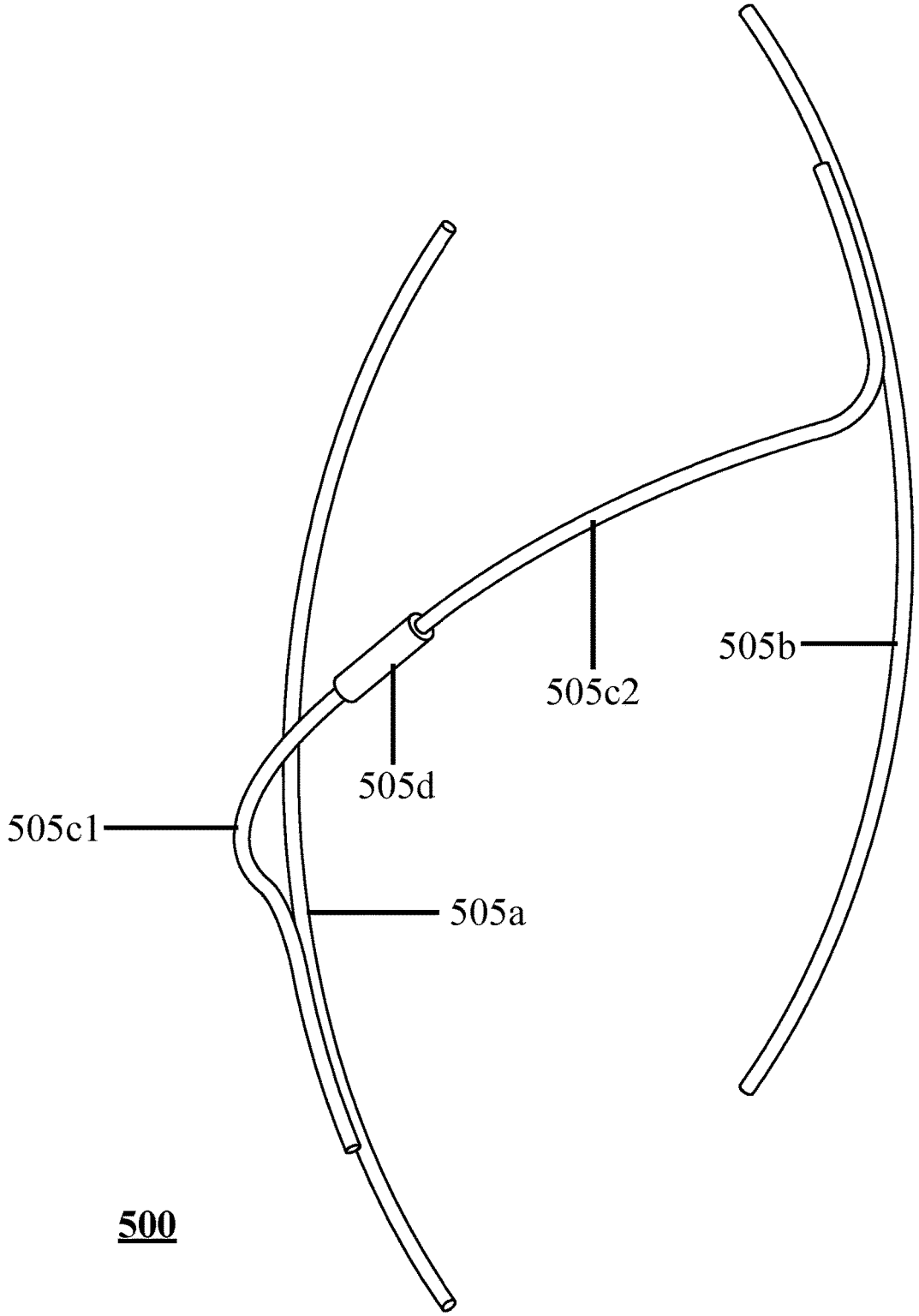
Figure 5C:
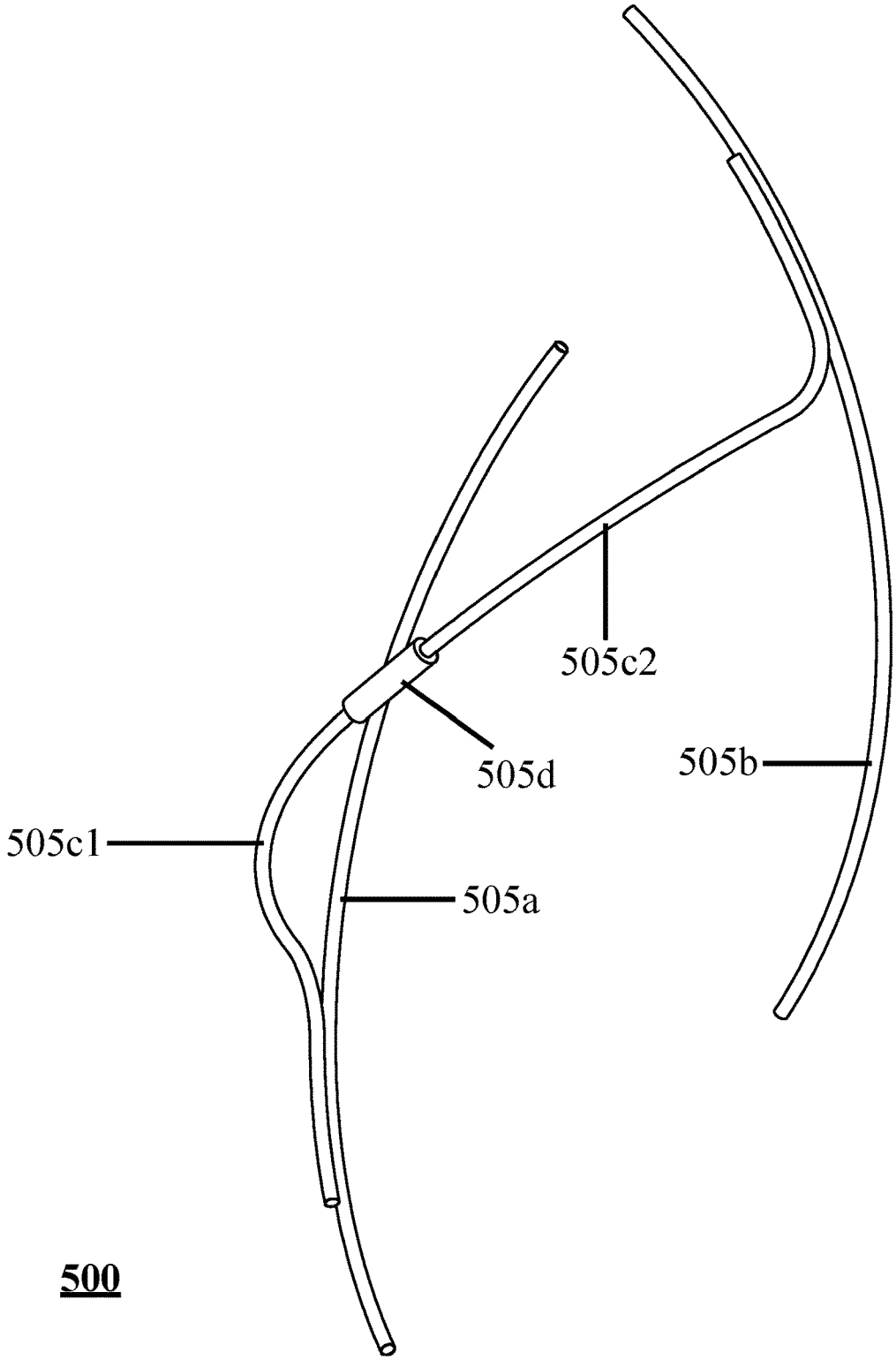

FIGS. 5*a*, 5*b*, and 5*c* show drawings of another alternate embodiment 500. In this embodiment, two curved base elements 505*a* and 505*b* are shown connected to one end each of roll-over bar pieces 505*c*1 and 505*c*2. The other ends of roll-over bar pieces 505*c*1 and 505*c*2 are connected by pivot 505*d*.

FIG. 5*a* is a top view, FIG. 5*b* is an oblique side view, and FIG. 5*c* is another oblique side view.

Example 6

Figure 6A:
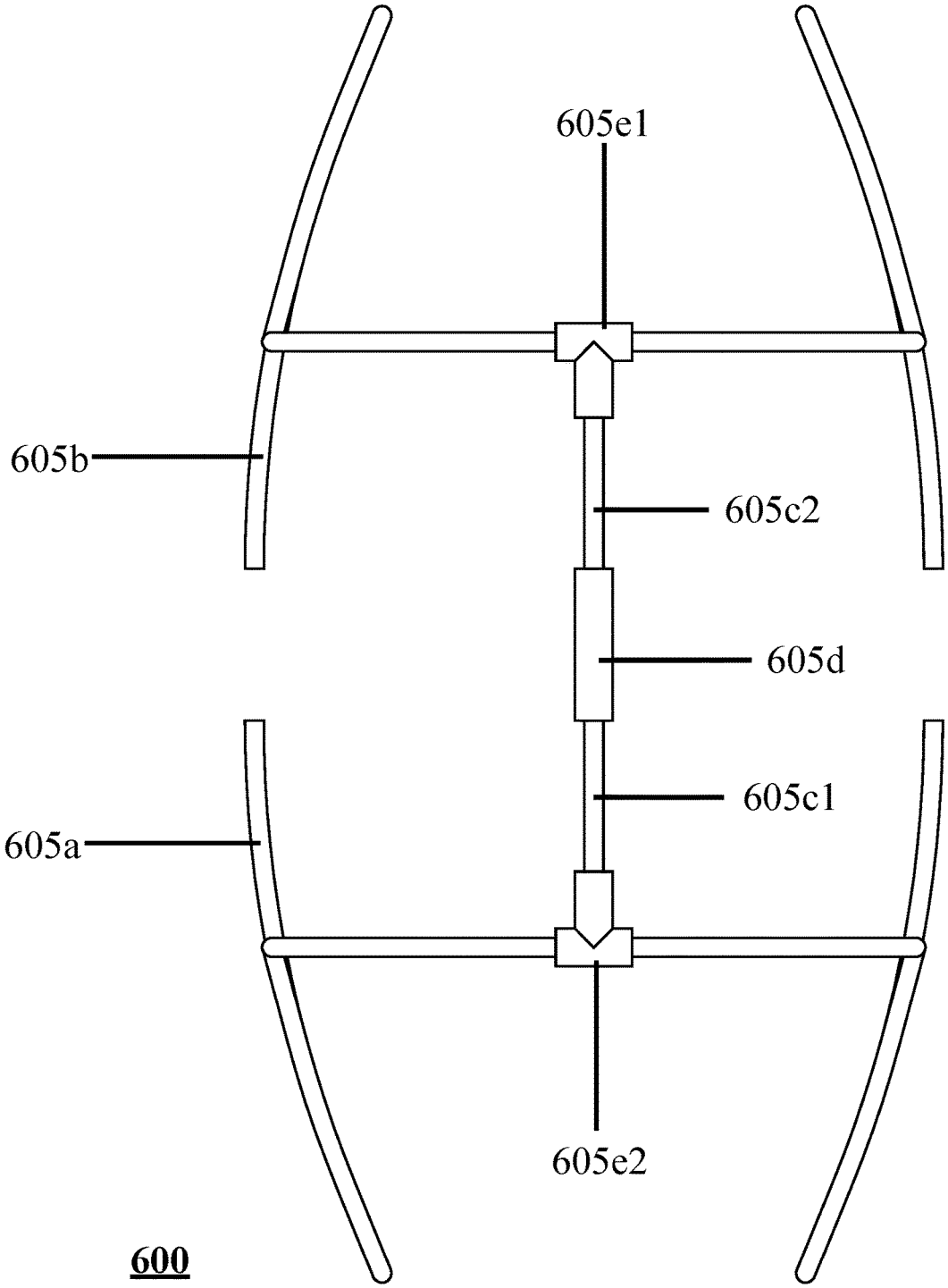
FIGS. 6*a*, 6*b*, and 6*c* show drawings of an alternative embodiment.
Figure 6B:
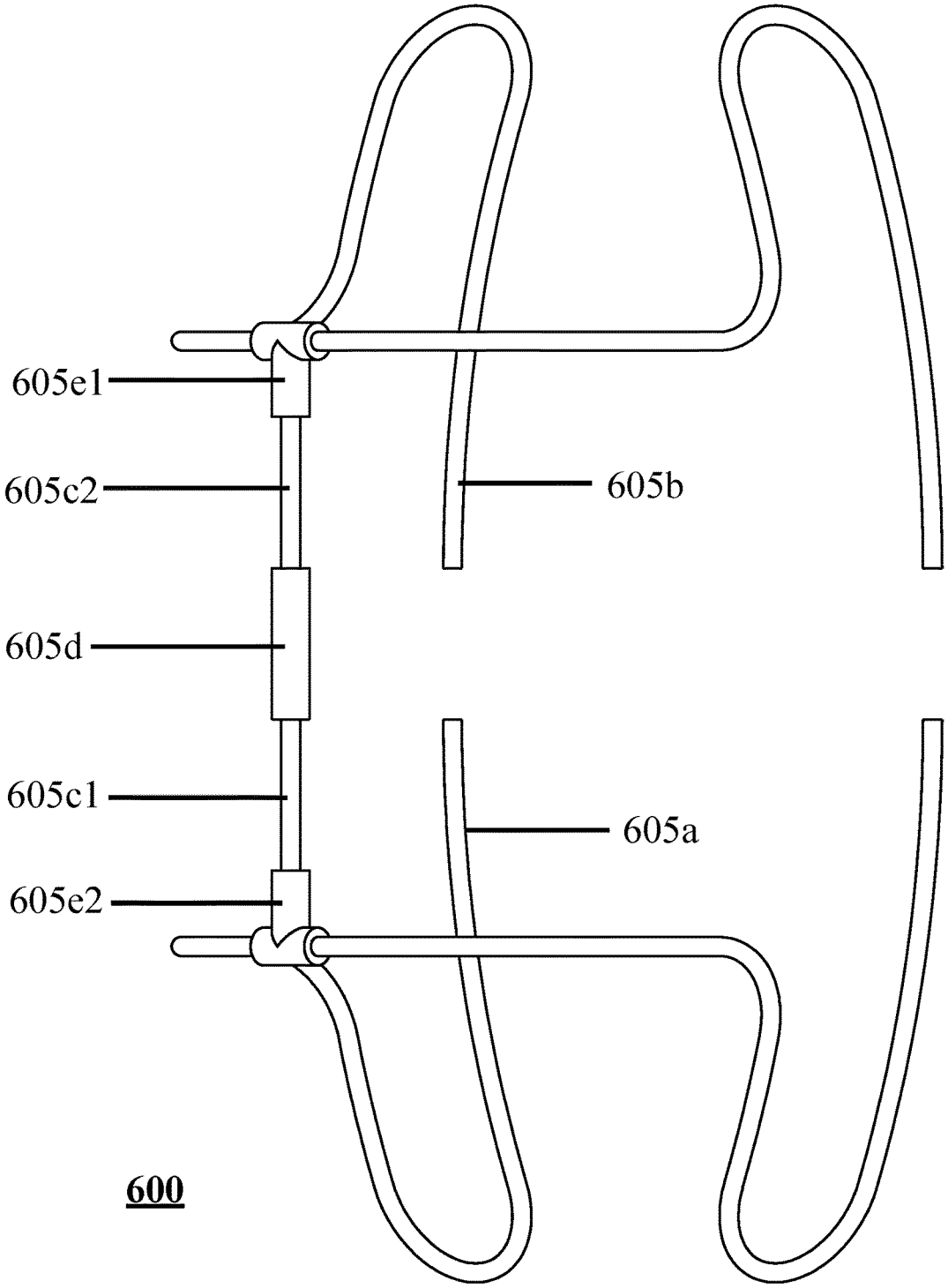
Figure 6C:
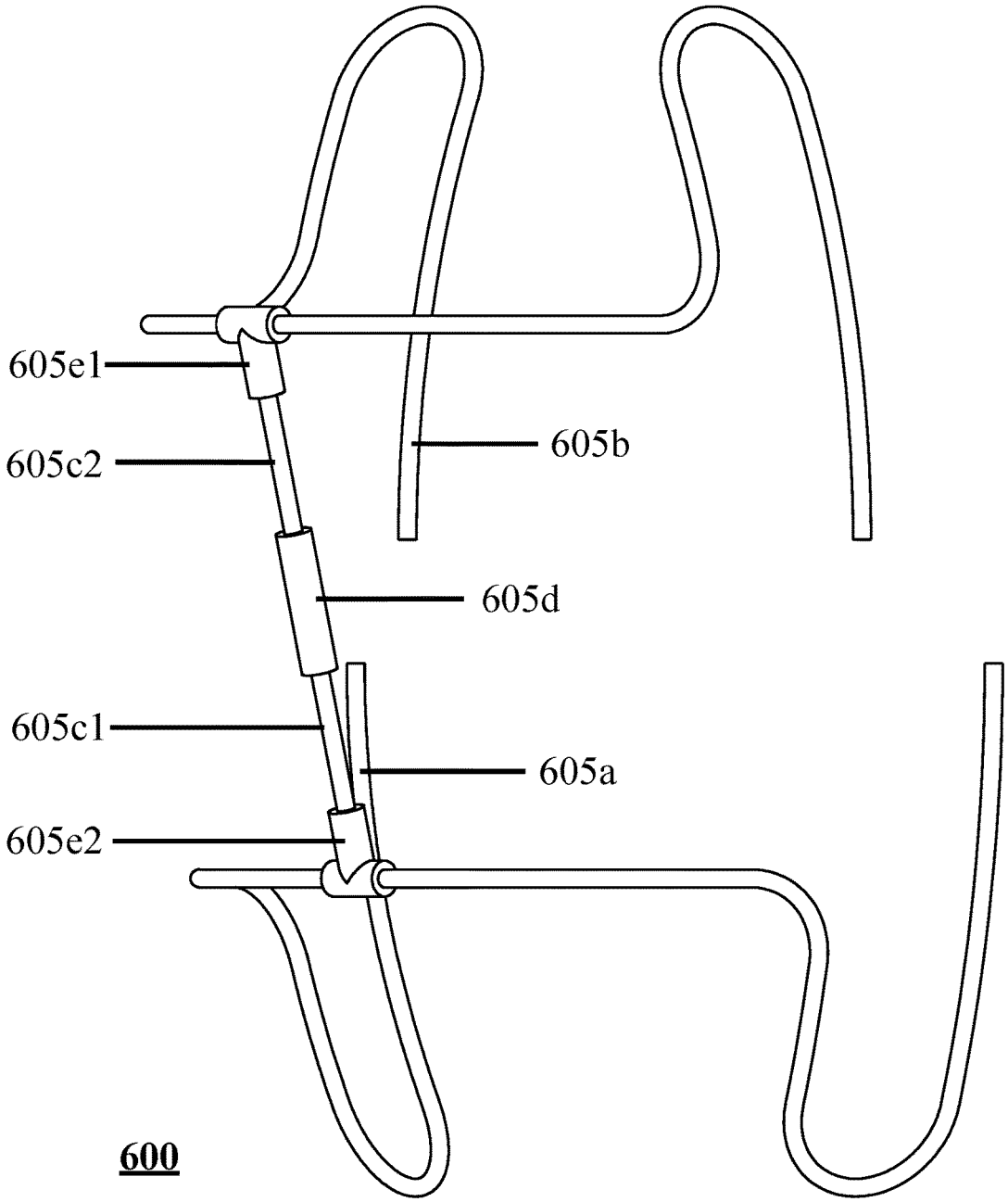

FIGS. 6*a*, 6*b*, and 6*c* show drawings of an alternative embodiment 600. This embodiment has two frame base pieces 605*a* and 605*b* that are contiguous with roll-over bar elements, where a portion of each frame base piece 605*a* and 605*b* are bent upwards to form portions of the roll-over bar.

The two portions of frame base pieces 605*a* and 605*b* that form lateral elements of the roll-over bar are connected to each other by way of a two-piece longitudinal element comprising 605*c*1 and 605*c*2. One end of each longitudinal elements 605*c*1 and 605*c*2 are joined together by pivot 605*d* in the middle of the roll-over bar, and the other ends of elements 605*c*1 and 605*c*2 are connected to the top portion of base pieces 605*a* and 605*b*, thereby forming a complete roll-over bar.

FIG. 6*a* is a top view, FIG. 6*b* is an oblique side view, and FIG. 6*c* is another oblique side view.

Example 7

Figure 7:
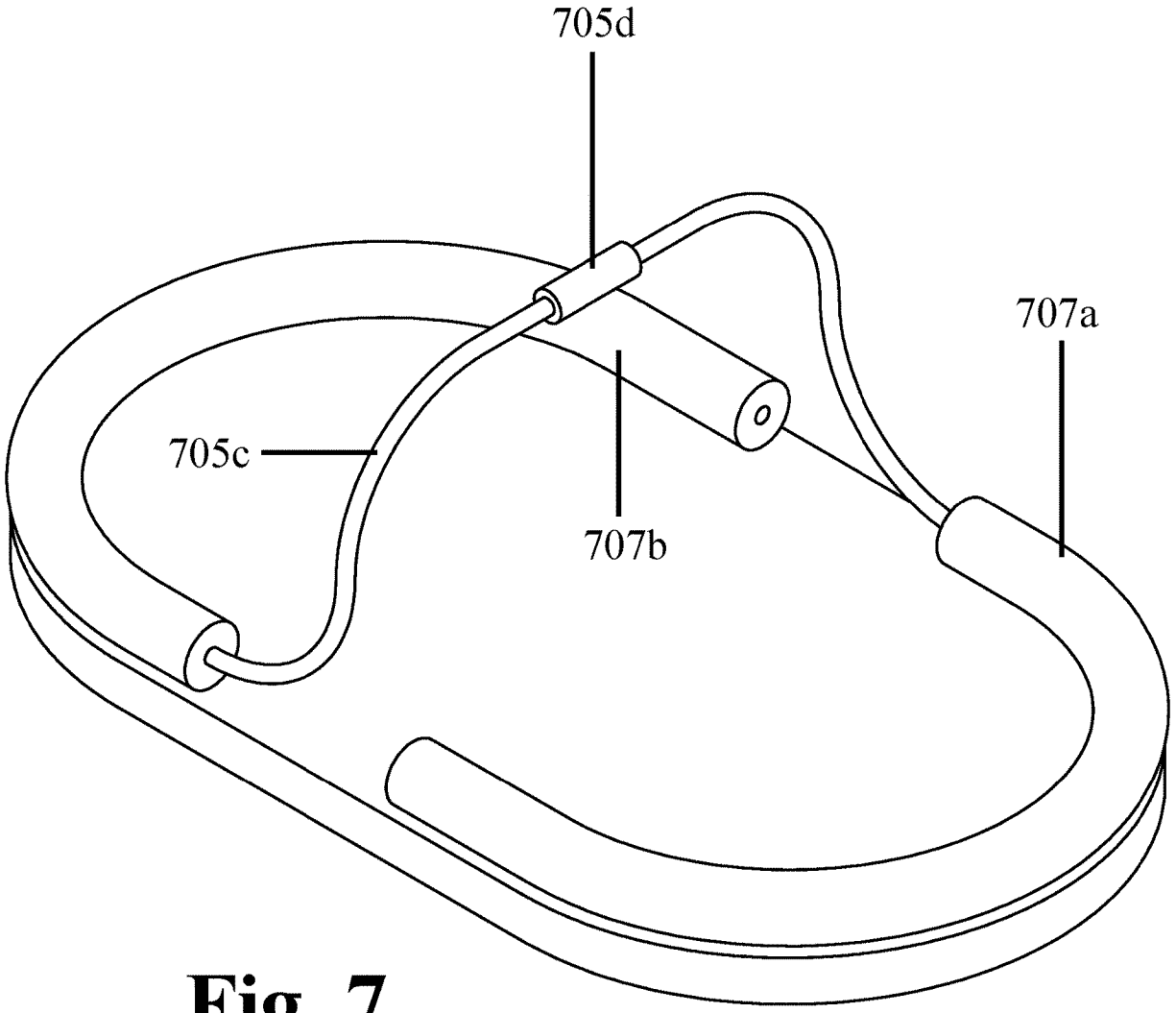
FIG. 7 shows a drawing of an embodiment similar to that of FIGS. 1*a*, 1*b*, and 1*c*, further including a pliable cover over the base of the device.

FIG. 7 shows a drawing of an embodiment 700 similar to that of FIGS. 1*a*, 1*b*, and 1*c*, further including pliable covers 707*a* and 707*b* over the frame base elements of the device.

Example 8

Figure 8A:
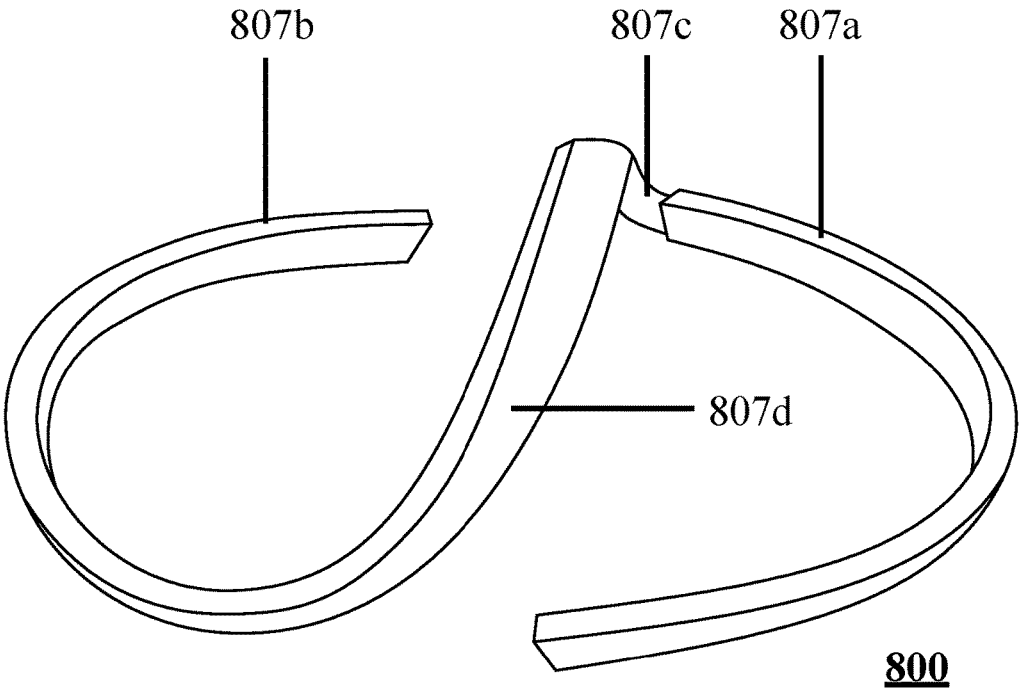
FIGS. 8*a* and 8*b* depict drawings of embodiments comprising flattened bands of material covered by a pliable covering.
Figure 8B:
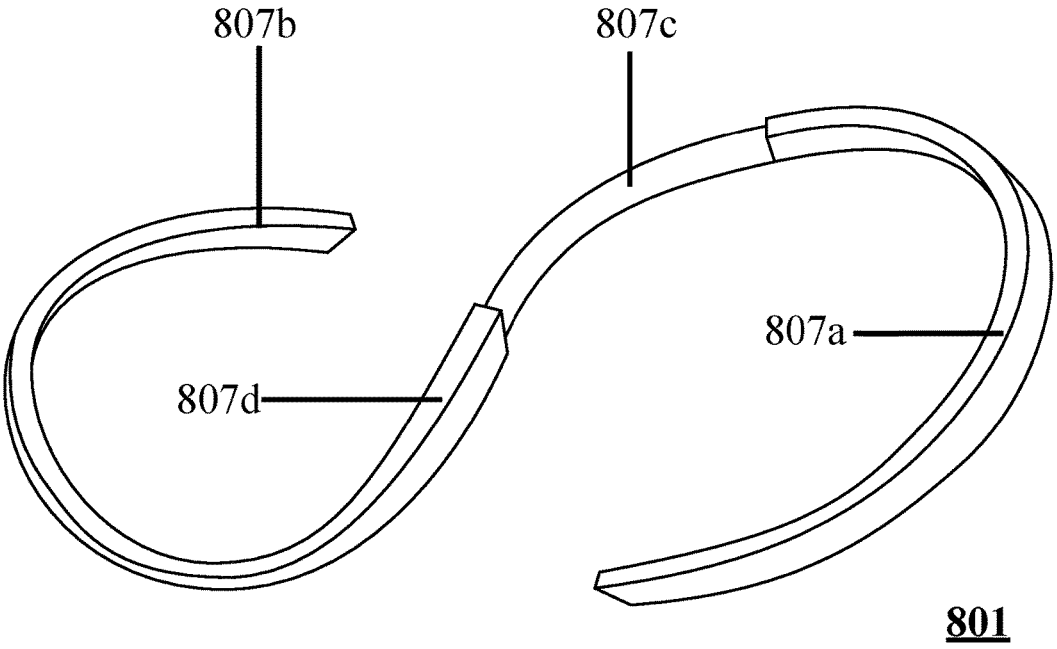

FIGS. 8*a* and 8*b* depict drawings of embodiment 800 comprising flattened bands of material covered by a pliable covering. FIG. 8*a* depicts a drawing of embodiment 800, comprising frame base 807*a* and 807*b* connected together by roll-over bar 807*d* and connected to frame base portions 807*a* and 807*b* by hinge 807*c*. In this configuration, frame base portions 807*a* and 807*b* are shown on a sleeping surface and roll-over bar 807*d* is shown elevated to reduce pressure on a neonate's extremity.

FIG. 8*b* depicts a drawing of embodiment 801 where the embodiment 800 where roll-over bar 807*d* is connected to frame base portions 807*a* and 807*b* by hinge 807*c*, which has been moved to permit roll-over bar 807*d* to be lowered toward the sleeping surface, thereby elevating frame base portions to reduce pressure on a neonate's extremity.

Example 9

Figure 9A:
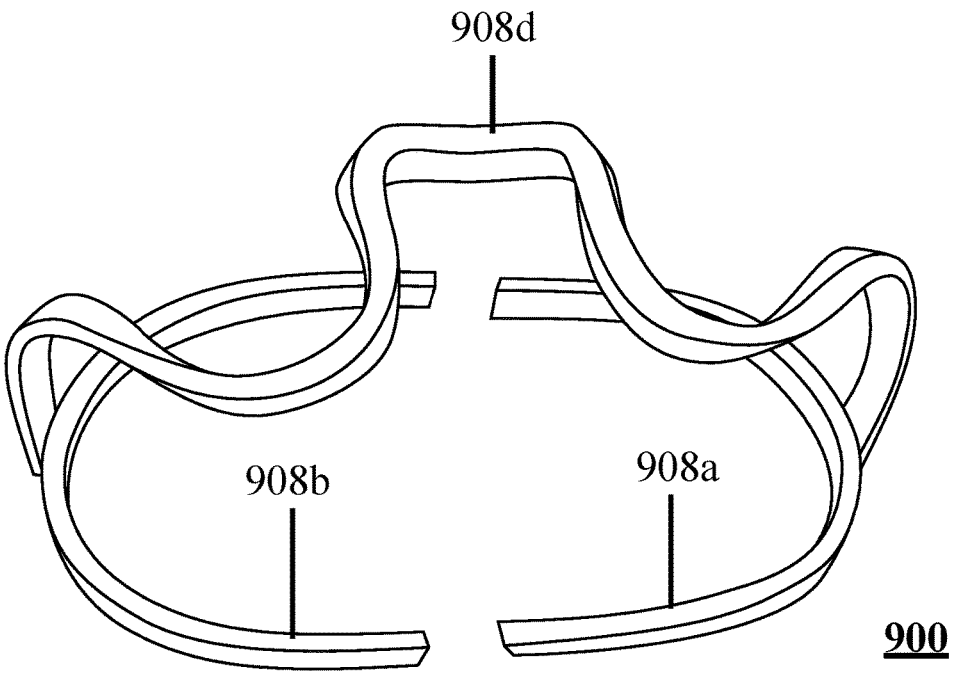
FIGS. 9*a* and 9*b* depict drawings of embodiments comprising flattened bands of material covered by a pliable covering.
Figure 9B:
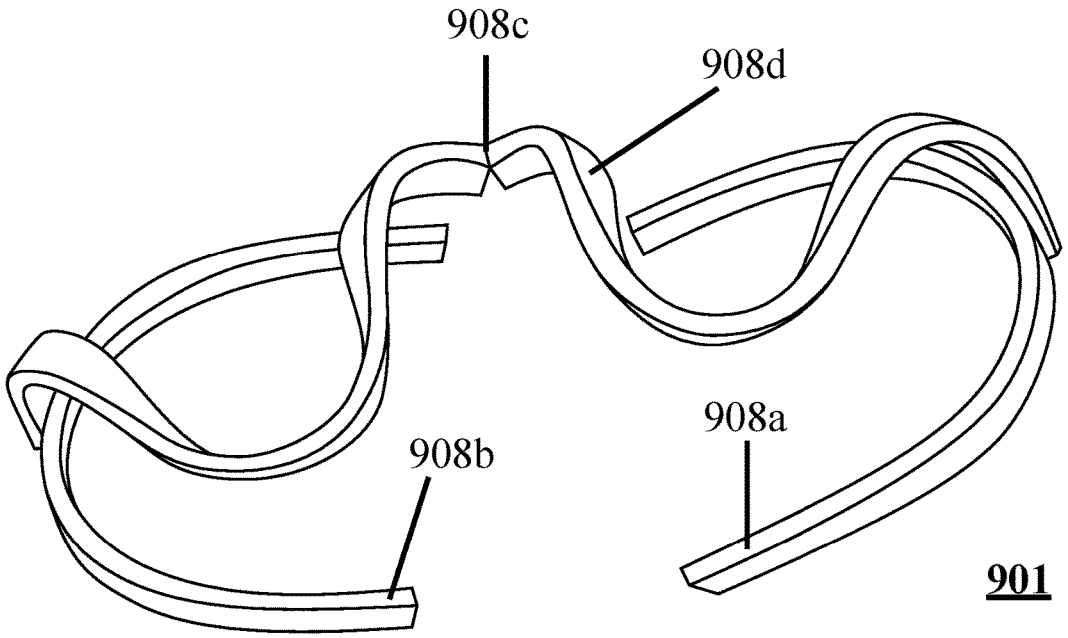

FIGS. 9*a* and 9*b* depict drawings of embodiments 900 and 901 respectively, comprising flattened bands of material optionally covered at least in part by a pliable covering. FIG. 9*a* depicts a drawing of embodiment 900 comprising frame base portions 908*a* and 908*b* shown on a sleeping surface. Roll-over bar 908*d* is shown elevated above frame base portions 908*a* and 908*b* to reduce pressure on a neonate's extremity.

FIG. 9*b* depicts a drawing of an embodiment 901 where the embodiment 900 is shown with roll-over bar 908*d* flexed at hinge 908*c* to permit the roll-over bar to be moved towards sleeping surface, thereby elevating parts of the frame base portions to permit an infant or caregiver to remove an extremity from under the frame base elements.

Example 10

Figure 10A:
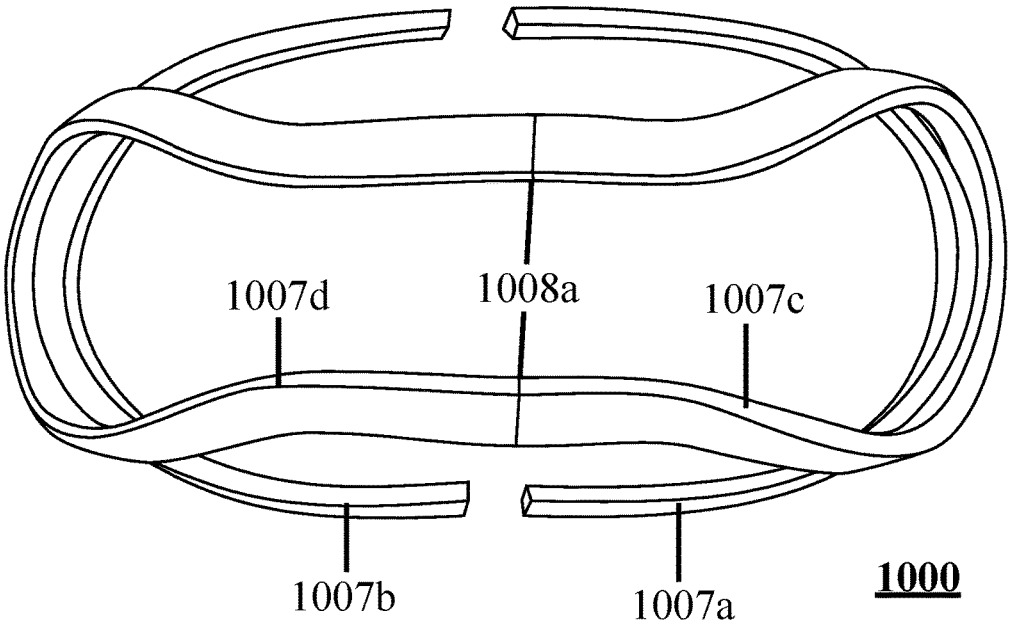
FIGS. 10*a* and 10*b* depict drawings of embodiments comprising flattened bands of material covered by a pliable covering.
Figure 10B:
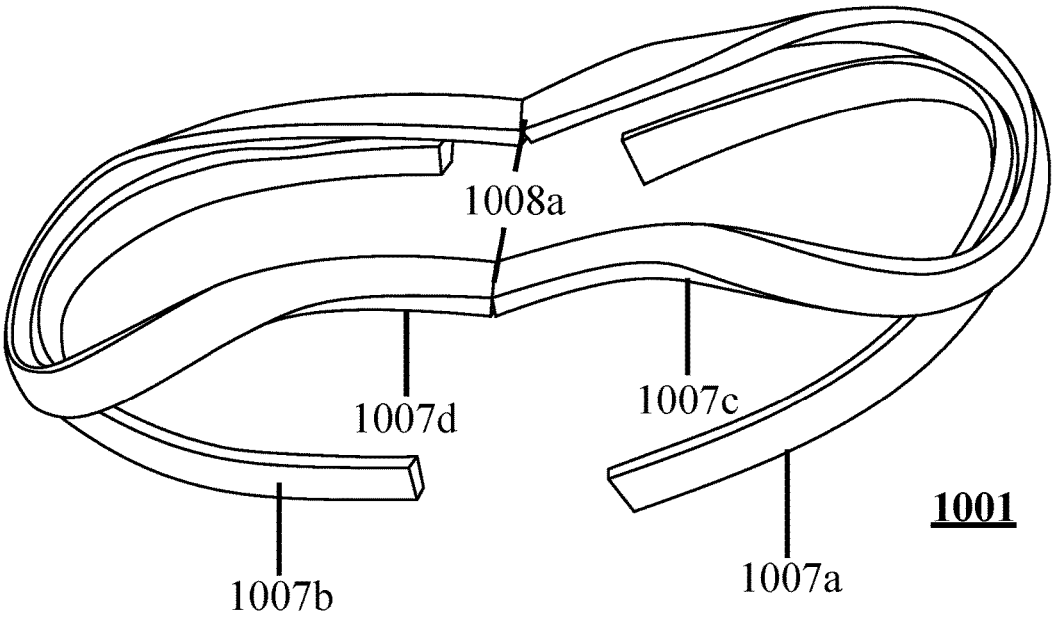

FIGS. 10*a* and 10*b* depict drawings of embodiments 1000 and 1001, respectively, comprising flattened bands of material optionally covered at least in part by a pliable covering. FIG. 10*a* depicts a drawing of embodiment 1000 shown in sleeping configuration with frame base portions 1007*a* and 1007*b* shown on a sleeping surface. In this configuration, roll-over bars 1007*c* and 1007*d* are connected by hinges 1008*a*, and are elevated to reduce pressure on a neonate's extremity.

FIG. 10*b* depicts a drawing of embodiment 1001 where the embodiment 1000 is shown. In this configuration roll-over bars 1007*c* and 1007*d* are flexed with respect to each other by hinge elements 1008*a*, thereby permitting roll-over bars 1007*c* and 1007*d* to be moved toward sleeping surface, thereby elevating frame base portions to reduce pressure on a neonate's extremity.

Example 11

Figure 11A:
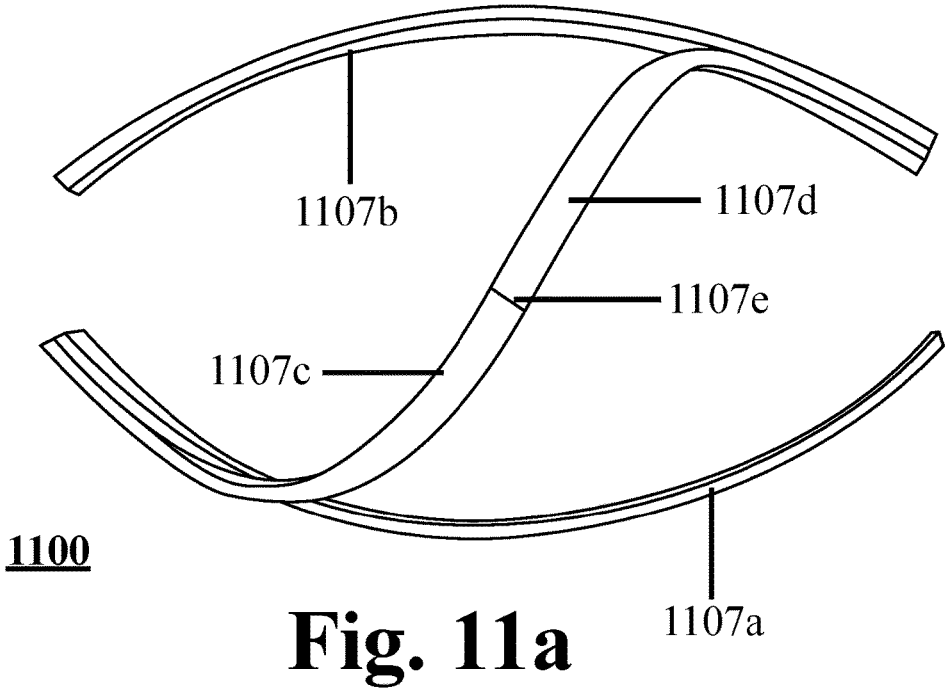
FIGS. 11*a* and 11*b* depict drawings of embodiments comprising flattened bands of material covered by a pliable covering. Embodiment 1100 is shown in closed configuration (FIG. 11*a*) and embodiment 1101 is shown in open configuration (FIG. 11*b*).
Figure 11B:
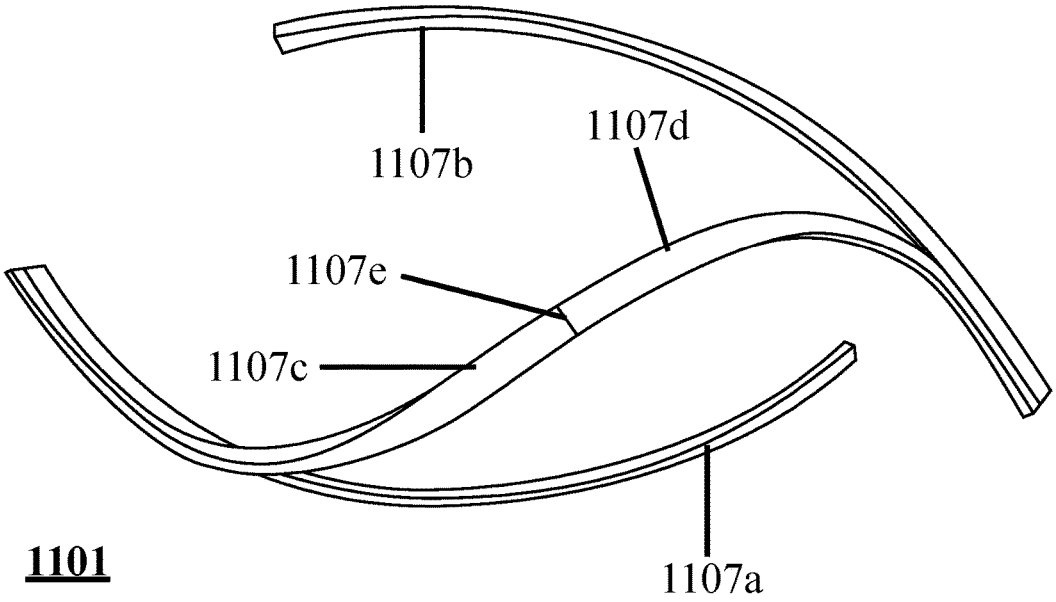

FIGS. 11*a* and 11*b* depict drawings of embodiments 1100 and 1101, respectively, comprising flattened bands of material covered by a pliable covering. FIG. 11*a* depicts a drawing of embodiment 1100 shown with frame base portions 1107*a* and 1107*b* shown on a sleeping surface. In this configuration, roll-over bars 1107*c* and 1107*d* are connected together by hinge 1107*e* and are elevated to reduce pressure on a neonate's extremity.

FIG. 11*b* depicts a drawing of embodiment 1101, similar to that of embodiment 1100. In this configuration roll-over bars 1107*c* and 1107*d* are flexed with respect to each other by hinge element 1008*a*, thereby permitting top portions 1007*c* and 1007*d* to be moved toward sleeping surface, thereby elevating frame base portions to reduce pressure on a neonate's extremity.

Example 12

Figure 12A:
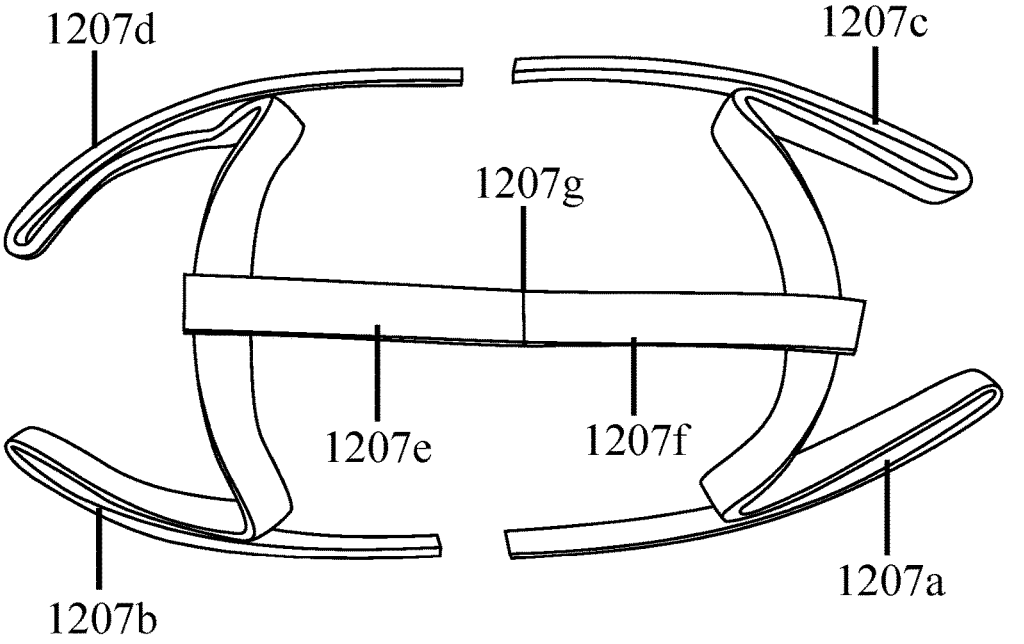
FIGS. 12*a* and 12*b* depict drawings of embodiments comprising flattened bands of material covered by a pliable covering. Embodiment 1200 is shown in closed configuration (FIG. 12*a*) and embodiment 1201 is shown in open configuration (FIG. 12*b*).
Figure 12B:
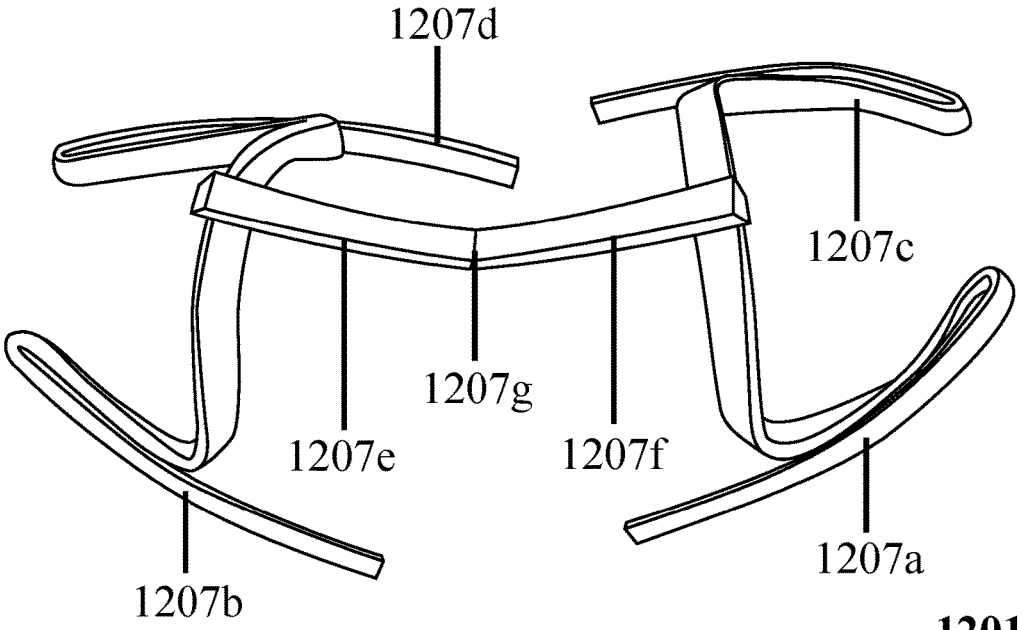

FIGS. 12*a* and 12*b* depict drawings of embodiments 1200 and 1201, respectively, comprising flattened bands of material covered by a pliable covering. Embodiment 1200 is shown having frame base portions 1207*a*, 1207*b*, 1207*c*, and 1207*d* on a sleeping surface. Elements 1207*a*, 1207*b*, 1027*c*, and 1027*d* are folded and elevated to create elevated portions to support roll-over bars 1207*e* and 1207*f* to reduce pressure on a neonate's extremity. Elements 1207*e* and 1207*f* are connected by hinge 1207*g*.

FIG. 12*b* depicts a drawing of embodiment 1201, similar to that of embodiment 1200. In this embodiment, roll-over bars 1207*e* and 1207*f* are flexed with respect to each other by hinge 1207*g*, thereby permitting roll-over bars 1207*e* and 1207*f* to be moved toward sleeping surface, thereby elevating frame base portions to reduce pressure on a neonate's extremity.

Methods for Protecting Neonates During Bed-Sharing and Co-Sleeping

In use, a device of this disclosure is placed on a sleeping surface, such as a bed, and the base portions are arranged to make contact with the sleeping surface. In embodiments in which the frame base portions can be moved relative to each other, the frame base portions are separated from each other to permit hinge functions. Then, the frame base portions of the device are moved into proximity with each other and surrounding the neonate or infant, with the roll-over bar(s) located above the neonate.

In situations in which the neonate's leg(s), arm(s), or head is moved underneath a frame base portion, or where a co-sleeper moves on top of the device, or where the neonate cries or is otherwise believed to be distressed, the frame base portion(s) are moved away from the neonate by moving one or more motion limited hinges, pivots, or rotational and re-adjusting the position of the frame base. Then the frame base portions can be returned to their normal positions, making contact with the sleeping surface.

In embodiments comprising one or more position or pressure sensors, if a neonate moves an arm(s), leg(s) or head under a frame base portion, a sensor detects the abnormal position or pressure, and communicates with an alarm to notify a co-sleeper or caregiver of abnormal position or pressure, and then the co-sleeper or caregiver can re-adjust the neonate's position and return the frame base portion(s) and roll-over bar(s) to their normal positions.

Applications

The foregoing embodiments have broad applications. While examples disclosed herein may focus on the protection of infants or neonates, devices of this disclosure may also be used in animal husbandry, farm operations, and zoos or to protect any living or non living object from being crushed by larger ones.

Accordingly, the discussion of various designs is meant only to be exemplary and is not intended to limit the scope of the disclosure, including the claims.

Although the concept and implementation of the disclosures of this novel and non-obvious invention are provided, the dimensions and materials for the frame base(s) and roll-over bars, and the nature of the most practical and reliable hinges, pivot(s) rotation mechanisms, motion ranges and arrests, and frame connections can easily be chosen and adapted to various needs and safety requirements by an ordinary person skilled in the art.

INDUSTRIAL APPLICABILITY

Embodiments of this invention find industrial applicability in hospitals, the medical device field, and consumer product industries.

What is claimed is:

1. A frame for a protective enclosure to protect a neonate during bed-sharing and co-sleeping, comprising:

a frame base portion sized to accommodate a neonate and adapted to rest upon a sleeping surface;

a roll-over bar attached to said frame base portion, wherein said roll-over bar is arched above the sleeping surface, wherein said frame base and roll-over bar includes one or more hinges, pivots, or rotational elements, configured so as to elevate said frame base portion above said sleeping surface when a force or pressure is applied by a co-sleeper to said roll-over bar, and to permit placement or removal of said neonate from underneath the protective enclosure.

2. The frame of claim 1, wherein said frame base portion comprises a plurality of frame base elements, adapted to be moved relative to each other by pressure applied to said roll-over bar, said pressure acting to rotate said hinges, pivots or rotational elements to elevate said frame base portion above said sleeping surface, each of said frame base elements being connected to said roll-over bar.

3. The frame of claim 1, wherein said roll-over bar comprises a plurality of elements.

4. The frame of claim 2, said roll-over bar further comprising a plurality of elements connected together by one or more motion limited hinges, pivots, or rotational elements adapted to permit motion of said frame base element away from said sleeping surface.

5. The frame of claim 2, further comprising a plurality of roll-over bars.

6. The frame of claim 1, wherein said roll-over bar has an undulating shape.

7. The frame of claim 1, further comprising pliable covering on said base element or said roll-over bar.

8. The device of claim 1, further comprising one or more elements to affix said device to a portion of a bed.

9. The device of claim 1, further comprising one or pressure or movement sensors adapted to sense abnormal positioning of said device with respect to said neonate and to communicate with an alarm or recording device.

10. A method for protecting a neonate during bed-sharing and co-sleeping, comprising:

a) providing a frame of claim 1;

b) placing a neonate between elements of said frame base portion and underneath said roll-over bar;

c) adjusting said frame base portion into a position to encircle said neonate; and d) adjusting said roll-over bar into a position elevated above said neonate.

11. The method of claim 10, wherein said protective enclosure comprises one or more pressure or position sensors, wherein if said one or more sensors detects an abnormal position or pressure, said sensor transmits a signal to an alarm, triggering the alarm, and permitting a co-sleeper or caregiver to return the device to a proper configuration or to remove said neonate from under said device.

* * * * *